US009983535B2

(12) United States Patent
Ozawa

(10) Patent No.: US 9,983,535 B2
(45) Date of Patent: May 29, 2018

(54) PRESSING APPARATUS, SHEET CONVEYING APPARATUS, AND IMAGE FORMING SYSTEM

(71) Applicant: CANON FINETECH NISCA INC., Misato-shi (JP)

(72) Inventor: Masatoshi Ozawa, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days. days.

(21) Appl. No.: 15/295,091

(22) Filed: Oct. 17, 2016

(65) Prior Publication Data

US 2017/0131672 A1 May 11, 2017

(30) Foreign Application Priority Data

Nov. 6, 2015 (JP) ..... 2015-218895
Nov. 6, 2015 (JP) ..... 2015-218896

(51) Int. Cl.

| | |
|---|---|
| ***B65H 1/00*** | (2006.01) |
| ***G03G 15/00*** | (2006.01) |
| ***B65H 5/06*** | (2006.01) |
| ***B65H 1/04*** | (2006.01) |
| ***B65H 1/18*** | (2006.01) |
| *G03G 21/16* | (2006.01) |

(52) U.S. Cl.

CPC ..... *G03G 15/6529* (2013.01); *B65H 1/04* (2013.01); *B65H 1/18* (2013.01); *B65H 5/062* (2013.01); *B65H 2402/441* (2013.01); *G03G 21/1647* (2013.01); *G03G 2221/1684* (2013.01)

(58) Field of Classification Search

CPC ... G03G 2215/0054; G03G 2215/0154; G03G 2221/1651; G03G 2221/1654; G03G 2221/1684; G03G 2221/1687; G03G 2221/1884; B65H 2402/441; B65H 2403/61

See application file for complete search history.

(56) References Cited

U.S. PATENT DOCUMENTS 5,660,489 A 8/1997 Ishii et al.
9,540,196 B2 * 1/2017 Bauch ..... B21D 43/06
(Continued)

FOREIGN PATENT DOCUMENTS

JP 07097076 A * 4/1995
JP 09-025014 A 1/1997
JP 10-077132 A 3/1998
(Continued)

*Primary Examiner* — Howard J Sanders
(74) *Attorney, Agent, or Firm* — Fitzpatrick, Cella, Harper & Scinto

(57) ABSTRACT

A pressing apparatus configured to generate a force in a separating direction in which a first unit and a second unit being connected to each other are separated from each other, the pressing apparatus including: a pressing portion supported by the second unit to be turnable about a turn shaft and configured to press the first unit; and an urging portion configured to urge the pressing portion in a direction intersecting with the separating direction, wherein the pressing portion exerts the force on the first unit in the separating direction by an urging force of the urging portion in the direction intersecting with the separating direction.

20 Claims, 12 Drawing Sheets

(56) References Cited

U.S. PATENT DOCUMENTS

| | | | | |
|---|---|---|---|---|
| 9,657,505 | B2 * | 5/2017 | Yonemoto | E05D 11/082 |
| 2016/0258490 | A1 * | 9/2016 | Sasaki | F16D 1/10 |

FOREIGN PATENT DOCUMENTS

| | | | | |
|---|---|---|---|---|
| JP | 2001-130759 | A | | 5/2001 |
| JP | 2004-256186 | A | | 9/2004 |
| JP | 2012-027504 | A | | 2/2012 |
| JP | 2014065611 | A | * | 4/2014 |

* cited by examiner

PRESSING APPARATUS, SHEET CONVEYING APPARATUS, AND IMAGE FORMING SYSTEM

BACKGROUND OF THE INVENTION

Field of the Invention

The present invention relates to a pressing apparatus configured to generate a force in a direction in which two connected units are separated from each other, and a sheet conveying apparatus including the pressing apparatus and an image forming system including the sheet conveying apparatus.

Description of the Related Art

Hitherto, a sheet conveying apparatus such as a sheet feeding apparatus configured to feed sheets to an image forming apparatus has been used in an image forming system such as a copying machine or a printer.

The sheet feeding apparatus is juxtaposed to the image forming apparatus and is configured to feed sheets into the image forming apparatus through a feeding outlet of the sheet feeding apparatus connected to a feeding inlet formed in a side portion of the image forming apparatus. Further, as for the sheet feeding apparatus as described above, in Japanese Patent Application Laid-Open No. 2004-256186, there is described a technique of providing a spring between the sheet feeding apparatus and the image forming apparatus to exert a force in a direction in which the sheet feeding apparatus is pushed out of the image forming apparatus, to thereby reduce force required for a user to pull the sheet feeding apparatus out of the image forming apparatus.

In order to shorten a distance over which the user is to operate, a stroke of the spring acting on the sheet feeding apparatus is suitably increased. However, there is a problem in that the increased stroke inevitably increases a length of a member such as the spring in a separating direction, thus increasing a space in the separating direction.

SUMMARY OF THE INVENTION

The present invention has been made to solve the above-mentioned problem, and an object of the present invention is to achieve a configuration for separating two connected units from each other while saving a space.

According to one embodiment of the present invention, there is provided a pressing apparatus configured to generate a force in a separating direction in which a first unit and a second unit being connected to each other are separated from each other, the pressing apparatus comprising: a pressing portion supported by the second unit to be turnable about a turn shaft and configured to press the first unit; and an urging portion configured to urge the pressing portion in a direction intersecting with the separating direction, wherein the pressing portion exerts the force on the first unit in the separating direction by an urging force of the urging portion in the direction intersecting with the separating direction.

Further features of the present invention will become apparent from the following description of exemplary embodiments with reference to the attached drawings.

DESCRIPTION OF THE EMBODIMENTS

Now, an embodiment of the present invention will be described in detail with reference to the attached drawings. In the following description in the specification, a "sheet width direction" represents a direction which intersects with a sheet conveyance direction from a sheet conveying apparatus (hereinafter referred to as "sheet feeding apparatus") 5 to an image forming apparatus 2 (in the embodiment, it is assumed that the sheet width direction is a direction perpendicular to the sheet conveying direction).

Figure 1:
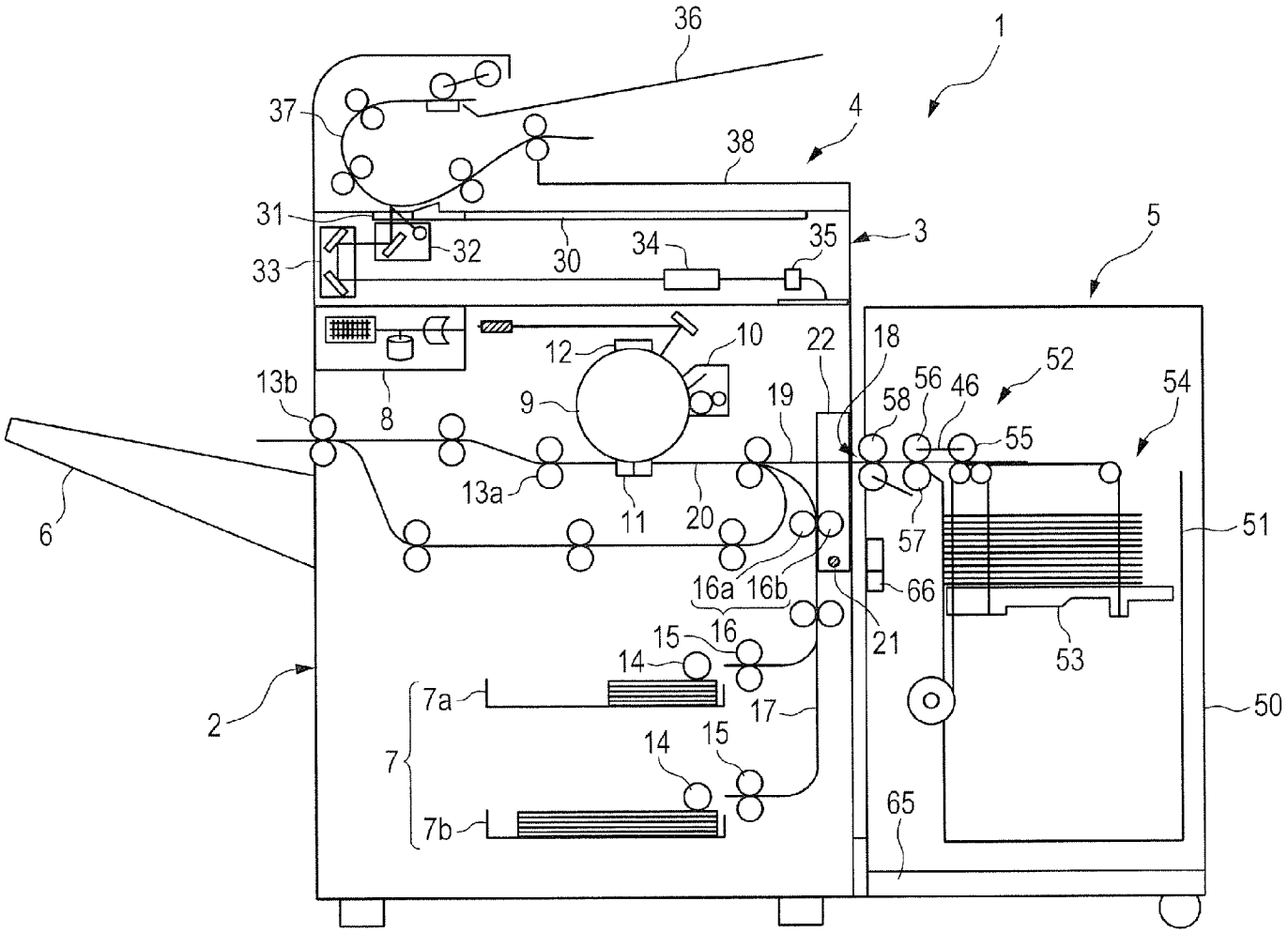
FIG. 1 is an overall configuration view of an image forming system including a pressing apparatus according to an embodiment of the present invention.

First, an overall configuration of an image forming system 1 will be described with reference to FIG. 1 and FIG. 2. The image forming system 1 includes the image forming apparatus 2, a document reading apparatus 3, a document feeding apparatus 4, the sheet feeding apparatus 5, and a sheet stacking apparatus 6. The image forming apparatus 2 includes sheet feeding cassettes 7 each configured to store about 100 sheets (two sheet feeding cassettes 7*a* and 7*b* are provided in the illustrated embodiment). The image forming apparatus 2 performs an image forming operation, which is based on image data read from an image of a document by the document reading apparatus 3, onto a sheet fed from any one of the sheet feeding cassette 7*a*, the sheet feeding cassette 7*b*, and the sheet feeding apparatus 5. The image forming apparatus 2 allows the sheet bearing the image formed thereon to be collected and stacked on the sheet stacking apparatus 6.

A document sheet can be fed to the document reading apparatus 3 also by the document feeding apparatus 4.

Sheets that are used in the image forming system 1 may include sheets of plain paper, OHP, tracing paper and coated paper.

The image forming apparatus 2 is, for example, a copying machine, a printer, or a facsimile machine, and is preferred to be immovably placed on a floor surface. The image forming apparatus 2 need only be capable of forming an image on a sheet, and hence various image forming mechanisms may be employed. In the illustrated embodiment, an electrostatic image forming mechanism is employed as an image forming mechanism.

However, the image forming mechanism of the image forming apparatus 2 is not limited to the electrostatic or electrophotographic image forming mechanism, and mechanisms such as an ink jet image forming mechanism and an offset image forming mechanism may also be employed.

Figure 2:
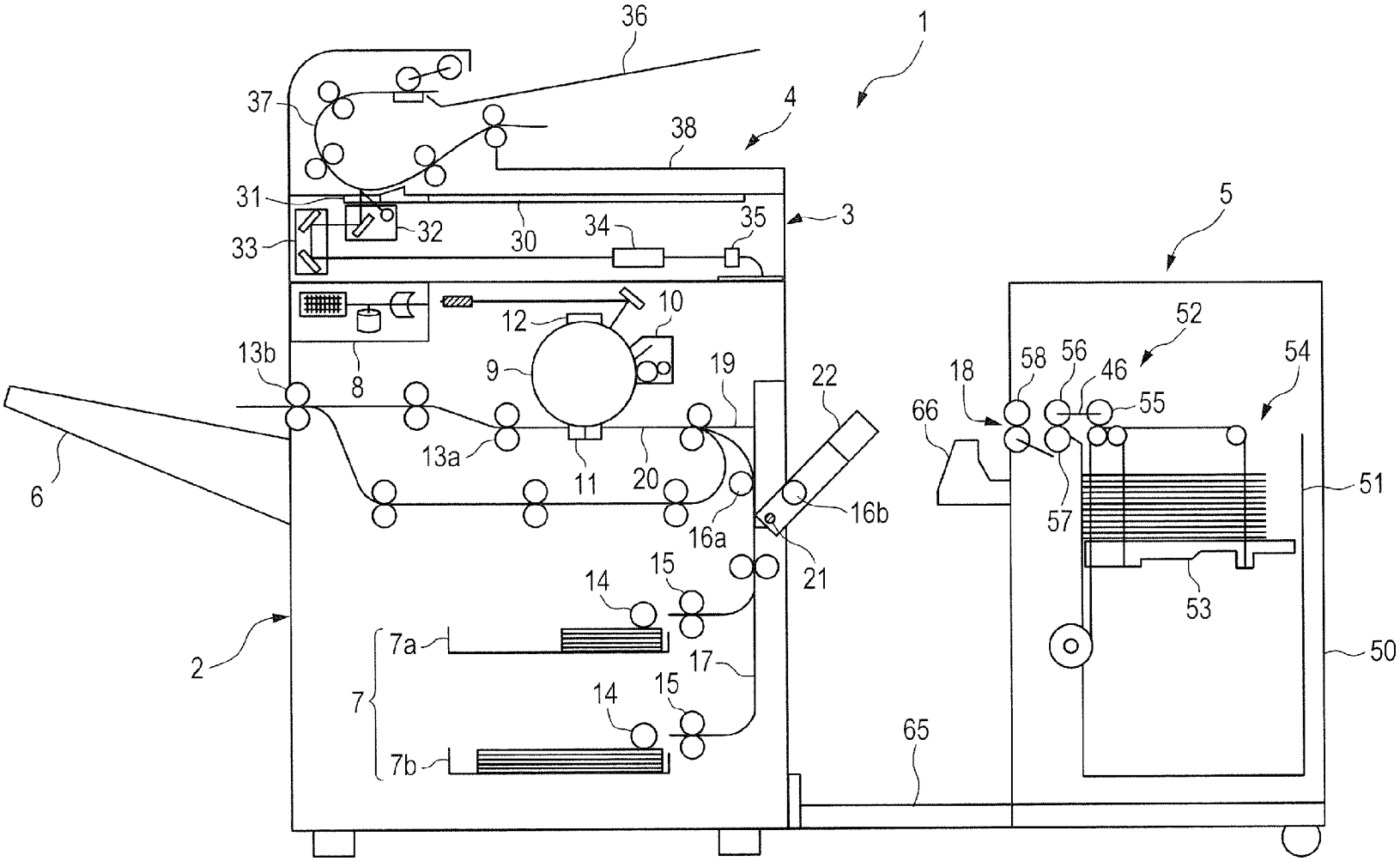
FIG. 2 is an explanatory view for illustrating a state in which a sheet feeding apparatus is separated from an image forming apparatus in the image forming system illustrated in FIG. 1.

The image forming apparatus 2 illustrated in FIG. and FIG. 2 includes a charger 12, an exposure device (such as a laser head) 8, a photosensitive drum 9, a developing unit 10, a transfer charger 11, and a fixing roller 13*a*. An electrostatic latent image (static image) is formed by the exposure device 8 on a surface of the photosensitive drum 9 charged by the charger 12. The developing unit 10 allows toner to adhere onto the electrostatic latent image. The toner adhering onto the photosensitive drum 9 is transferred, by the transfer charger 11, onto a sheet which is fed from the sheet feeding cassette 7*a*, the sheet feeding cassette 7*b*, or the sheet feeding apparatus 5.

The sheet on which the toner has been transferred is sent to the fixing roller 13*a* arranged on downstream, and the toner carried on the sheet is heated and fixed. After that, the sheet is delivered to the sheet stacking apparatus 6 by a sheet delivery roller pair 13*b*.

Each of the sheet feeding cassettes 7*a* and 7*b* includes a pickup roller 14 configured to come into contact with an uppermost surface of sheets stored therein to feed the sheets, and a separation roller pair 15 configured to separate the fed sheets one by one to feed a separated sheet.

The sheets fed from the sheet feeding cassette 7*a* or 7*b* by the pickup roller 14 and separated one by one by the separation roller pair 15 are conveyed by a conveyance roller pair 16 including a driving roller 16*a* and a driven roller 16*b* through a cassette conveyance path 17 which extends along a side portion facing the sheet feeding apparatus 5, and join a feeding path 19 communicating with a feeding outlet 18 of the sheet feeding apparatus 5. After that, the sheets are conveyed to the transfer charger 11 along a conveyance path 20.

The side portion of the image forming apparatus 2 facing the sheet feeding apparatus 5 includes an openable and closable cover 22 which is turnable about an opening and closing turn shaft 21 between an open position for opening the inside of the image forming apparatus 2 and a closed position for covering the inside of the image forming apparatus 2. A part of the cassette conveyance path 17 including the driven roller 16*b* is formed so as to move integrally with the openable and closable cover 22.

According to the embodiment, a lower end portion of the openable and closable cover 22 is supported on the side portion of the image forming apparatus 2 so that the openable and closable cover 22 can turn about the opening and closing turn shaft 21 extending substantially in a horizontal direction (direction intersecting with a predetermined plane extending in the sheet conveying direction and in a vertical direction). However, the opening and closing turn shaft 21 may extend substantially in the vertical direction (vertically). In this case, a left or right side of the openable and closable cover 22 is supported on the side portion of the image forming apparatus 2.

Figure 3:
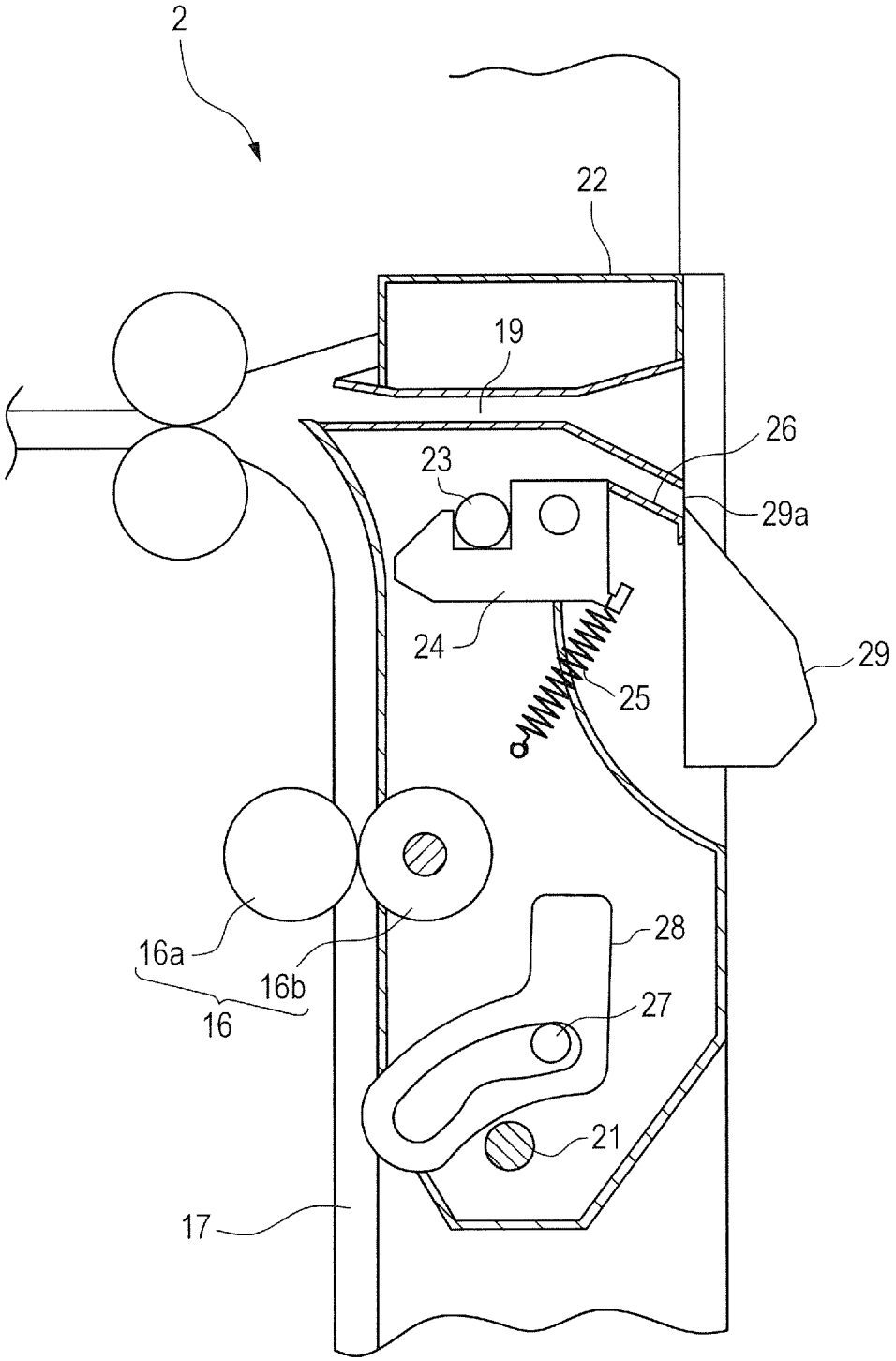
FIG. 3 is an enlarged partial sectional view for illustrating an openable and closable cover of the image forming apparatus.

As illustrated in FIG. 3, an end portion of the openable and closable cover 22 opposite to the opening and closing turn shaft 21 includes a locking claw 24 configured to come into engagement with a locking pin 23 fixed to a main body of the image forming apparatus 2. The locking claw 24 is turnably supported by the openable and closable cover 22 and is urged by an urging spring 25 toward a locked position for engagement with the locking pin 23. The locking claw 24 usually holds the openable and closable cover 22 in a closed state through engagement with the locking pin 23. Through a turning operation of the locking claw 24 with a handle 26, the locking claw 24 is brought out of engagement with the locking pin 23 to allow the openable and closable cover 22 to turn about the opening and closing turn shaft 21 to be moved from the closed position to the open position.

In other words, the locking pin 23 and the locking claw 24 construct a locking mechanism configured to engage the openable and closable cover 22 with the image forming apparatus 2.

Further, as illustrated in FIG. 3, a leading guide 29 projecting toward the sheet feeding apparatus 5 and having an upwardly inclined surface is arranged on the side portion of the openable and closable cover 22 facing the sheet feeding apparatus 5.

When the sheet feeding apparatus 5 is caused to approach to the image forming apparatus 2 to be connected thereto, the leading guide 29 comes into contact with a guiding roller 64 mounted to an extremity portion of a guide block 63, which is to be described later, of the sheet feeding apparatus 5 to guide the guiding roller 64 along the inclined surface to a regulating portion 29*a* located above, thereby raising a lower guide 61 mounted to the guide block 63 to an operating position.

The openable and closable cover 22 according to the embodiment is set to be turnable by about 40° from the closed position to the open position by an angle regulating member 28 which comes into engagement with a regulating pin 27 provided in the image forming apparatus 2.

However, the opening angle of the openable and closable cover 22 is not particularly limited and can be an appropriate angle within an acute angle range as long as the upper end portion of the opened openable and closable cover 22 comes into contact with an inclined surface 70*d* of a pressing member 70 of a pressing apparatus 66, which will be described later, when the sheet feeding apparatus 5 is connected to the image forming apparatus 2 from a separated state.

Arrangement of such openable and closable cover allows the locking claw 24 to be brought out of engagement with the locking pin 23 in a state in which the sheet feeding apparatus 5 is separated from the image forming apparatus 2, to turn the openable and closable cover 22 about the opening and closing turn shaft 21 from the closed position toward the sheet feeding apparatus 5 to the open position, thereby being capable of opening the cassette conveyance path 17.

On top of the document reading apparatus 3, there are provided a first platen 30 and a second platen 31, which are made of transparent glass, juxtaposed in a horizontal direction. The first platen 30 is used for reading a document set thereon by hand, and is formed to have such a size as to enable placement of a document having an applicable maximum size. The second platen 31 is used for reading a document which is fed from the document feeding apparatus 4 and moved at a predetermined speed.

In the document reading apparatus 3, there are provided a first reading carriage 32, a second reading carriage 33, a condenser lens 34, and a photoelectric conversion unit including a photoelectric conversion element 35. The first reading carriage 32 and the second reading carriage 33 are driven by a carriage motor (not shown) to reciprocate in a sub-scanning direction under the first platen 30.

The first reading carriage 32 is provided with a lamp configured to irradiate light to a document, and a mirror configured to reflect light reflected from the document. The second reading carriage 33 is provided with two mirrors configured to guide the light from the mirror of the first reading carriage 32 to the condenser lens 34 and the photoelectric conversion element 35.

When a document placed on the first platen 30 is to be read, light is irradiated from the first reading carriage 32 to an image of the document placed on the first platen 30 while the first reading carriage 32 and the second reading carriage 33 are moved. Light reflected from the document is guided to the photoelectric conversion element 35 through the first reading carriage 32 and the second reading carriage 33 and converted into an electric signal. Accordingly, image data is generated from the document. The image data generated in such a manner is transmitted as an image signal to the exposure device 8 of the image forming apparatus 2.

The document feeding apparatus 4 includes a feeding tray 36, a document conveyance mechanism 37, and a delivery tray 38. Documents placed on the feeding tray 36 are conveyed one after another by the document conveyance mechanism 37, passed above the second platen 31, and delivered to the delivery tray 38.

When a document that is fed from the document feeding apparatus 4 and passed above the second platen 31 is to be read, the first reading carriage 32 and the second reading carriage 33 are stopped in advance under the second platen 31, and image data is generated from the document passed above the second platen 31.

The sheet feeding apparatus 5 includes a housing (feeding apparatus body) 50, a storage unit 51 which is drawably supported by a drawing mechanism (not shown) in the housing 50 and serves as a stacking unit configured to stack sheets, and a separating and feeding mechanism 52 configured to separate the sheets stored in the storage unit 51 one by one and feed the sheet to the image forming apparatus 2. In the storage unit 51, there is provided a stacking tray 53 serving as a lifter which is configured to rise and lower in an up-and-down direction.

The stacking tray 53 is a flat plate, and sheets can be stacked on the stacking tray 53. Further, at an upper part of the storage unit 51, there is provided a sheet upper surface detection sensor (not shown) configured to detect a position of an uppermost surface of sheets stacked on the stacking tray 53 so that the stacking tray 53 is moved by a lifting mechanism 54 in accordance with an amount of sheets.

Figure 4:
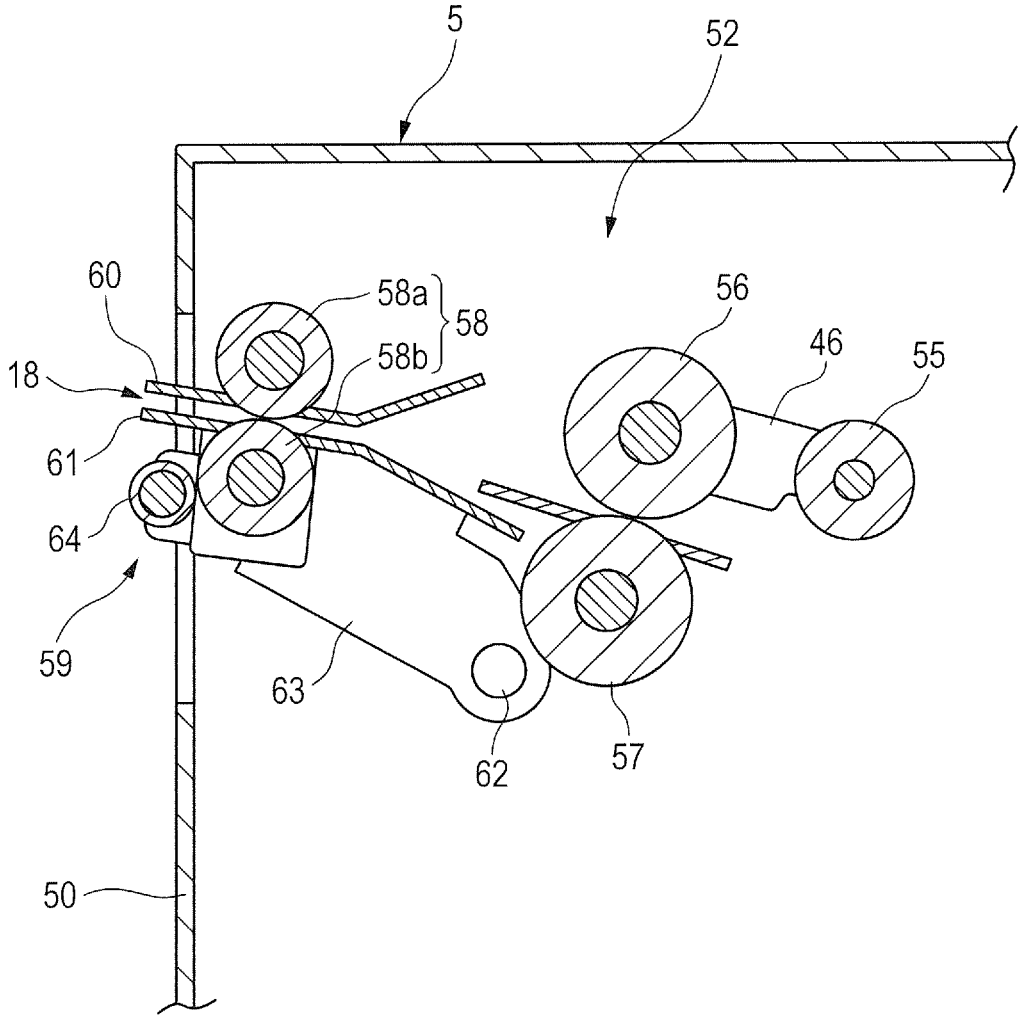
FIG. 4 is an enlarged partial sectional view for illustrating a separating and feeding mechanism of the sheet feeding apparatus.

As illustrated in detail in FIG. 4, the separating and feeding mechanism 52 includes a delivery roller 55 configured to come in contact with an uppermost surface of the sheets stacked on the stacking tray 53 to deliver sheets, a separating unit configured to separate the delivered sheets one by one and feed the sheet, and a conveyance roller pair 58 configured to convey the sheet separated one by one by the separating unit to the image forming apparatus 2.

The separating unit includes a feeding roller 56 and a separating roller 57 which comes in press contact with the feeding roller 56 to prevent feeding of a second uppermost sheet and subsequent sheets.

The feeding roller 56 is configured to be driven by a feeding motor (not shown) through a plurality of gears (not shown) and a timing belt (not shown), and driving of the feeding motor causes the feeding roller 56 to rotate and feed the sheet. As illustrated in FIG. 4, the delivery roller 55 is rotatably supported by a bracket 46 which is supported so as to be freely turnable about a shaft of the feeding roller 56. Rotation of the shaft of the feeding roller 56 by the feeding motor is transmitted to the delivery roller 55 through a plurality of gears to drive the delivery roller 55 to rotate.

The separating roller 57 has a torque limiter (not shown) mounted to its rotation shaft. Accordingly, when two or more overlapping sheets are nipped at a press-contact portion between the feeding roller 56 and the separating roller 57, the separating roller 57 is stopped to prevent feeding of a second uppermost sheet and subsequent sheets.

In other words, when a plurality of overlapping sheets enter a nip portion between the feeding roller 56 and the separating roller 57, a driving force of the feeding roller 56 is transmitted to the uppermost sheet, whereas rotation of the separating roller 57 is stopped, thereby causing slippage between the uppermost sheet and the second uppermost sheet and subsequent sheets, and separating the uppermost sheet from the second uppermost sheet and subsequent sheets. As a matter of course, a separating pad or other member may be used in place of the separating roller 57.

The conveyance roller pair 58 includes a driving roller **58*a* configured to be driven by a conveyance motor (not shown), and a driven roller 58*b* configured to follow the driving roller 58*a* to rotate. The conveyance motor (not shown) causes the driving roller 58*a* to rotate, and hence a sheet is delivered through a delivery port 18 of the sheet feeding apparatus 5 and fed to the image forming apparatus 2**.

The separating and feeding mechanism 52 further includes an upper guide 60 and the lower guide 61 provided so as to be opposed to each other to form a feeding path configured to guide sheets.

According to the embodiment, the upper guide 60 is fixed and mounted to the driving roller **58*a* of the conveyance roller pair 58, while the lower guide 61 and the driven roller 58*b* of the conveyance roller pair 58 are mounted onto the guide block 63 axially supported to be turnable between the operating position and an open position around a block turn shaft 62 provided in the vicinity of the separation roller 57. The upper guide 60, the lower guide 61, the guiding roller 64, which will be described later, and the conveyance roller pair 58 form a conveyance portion 59** of the present invention.

The guide block 63 further includes the guiding roller 64 mounted to the extremity portion of the guide block 63, which is located opposite to the block turn shaft 62. When the image forming apparatus 2 and the sheet feeding apparatus 5 are connected to each other (FIG. 9), the guiding roller 64 comes into contact with and is supported by the regulating portion **29*a* provided on the openable and closable cover 22, and hence the guide block 63** is held at the operating position.

At the operating position, the lower guide 61 mounted on an upper surface of the guide block 63 is arranged to be opposed to the upper guide 60 to form a conveyance path, and the driven roller **58*b* mounted on the guide block 63 is brought into pressure contact with the driving roller 58***a* to form the conveyance roller pair 58.

Meanwhile, when the sheet feeding apparatus 5 is separated from the image forming apparatus 2 (FIG. 10), the guiding roller 64 is dismounted from the regulating portion 29*a* so that support for an extremity portion of the guide block 63 is lost. The guide block 63 turns downward under its own weight from the operating position to the open position by a predetermined angle. At the open position, the lower guide 61 and the driven roller 58*b* mounted on the guide block 63 are separated from the upper guide 60 and the driving roller 58*a*, respectively, to open the feeding outlet 18 widely.

When the sheet feeding apparatus 5 is caused to approach to the image forming apparatus 2 having the openable and closable cover 22 held at the closed position in order to connect the sheet feeding apparatus 5 to the image forming apparatus 2 from the state in which the sheet feeding apparatus 5 and the image forming apparatus 2 are separated from each other, the guiding roller 64 comes into contact with the upwardly inclined surface of the leading guide 29 provided on the openable and closable cover 22 to be guided upward along the upwardly inclined surface.

With this, the guide block 63 turning to the open position under its own weight is caused to turn upward about the block turn shaft 62. Further, when the sheet feeding apparatus 5 is connected to the image forming apparatus 2, the guiding roller 64 reaches the regulating portion 29*a* provided on the openable and closable cover 22 along the leading guide 29 to cause the guide block 63 to turn again to the operating position, and hence the guide block 63 is held at the operating position in a state in which the extremity portion of the guide block 63 is supported by the regulating portion 29*a*.

The sheet feeding apparatus 5 configured as described above is mounted to be separable from the image forming apparatus 2 which is immovably placed on the floor surface, thereby enabling easy handling of paper jamming through separation of the sheet feeding apparatus 5 from the image forming apparatus 2 and opening the openable and closable cover 22 of the image forming apparatus 2 to open the cassette conveyance path 17, or through turning of the guide block 63 in a direction in which the lower guide 61 of the sheet feeding apparatus 5 is separated from the upper guide 60 to open the feeding outlet 18.

According to the embodiment, the sheet feeding apparatus 5 is placed on a guide rail 65 so that the sheet feeding apparatus 5 can be separated from and approach to the image forming apparatus 2 while being guided along the guide rail 65.

The image forming system 1 further includes the pressing apparatus (pressing mechanism) 66 configured to exert a force in a direction in which the sheet feeding apparatus 5 is separated from the image forming apparatus 2 to thereby separate the sheet feeding apparatus 5 or assist separation of the sheet feeding apparatus 5 from the image forming apparatus 2, and a connecting and holding mechanism (holding mechanism) 67 (FIG. 7 and FIG. 8) configured to keep a state in which the image forming apparatus 2 and the sheet feeding apparatus 5 are connected to each other.

Figure 5:
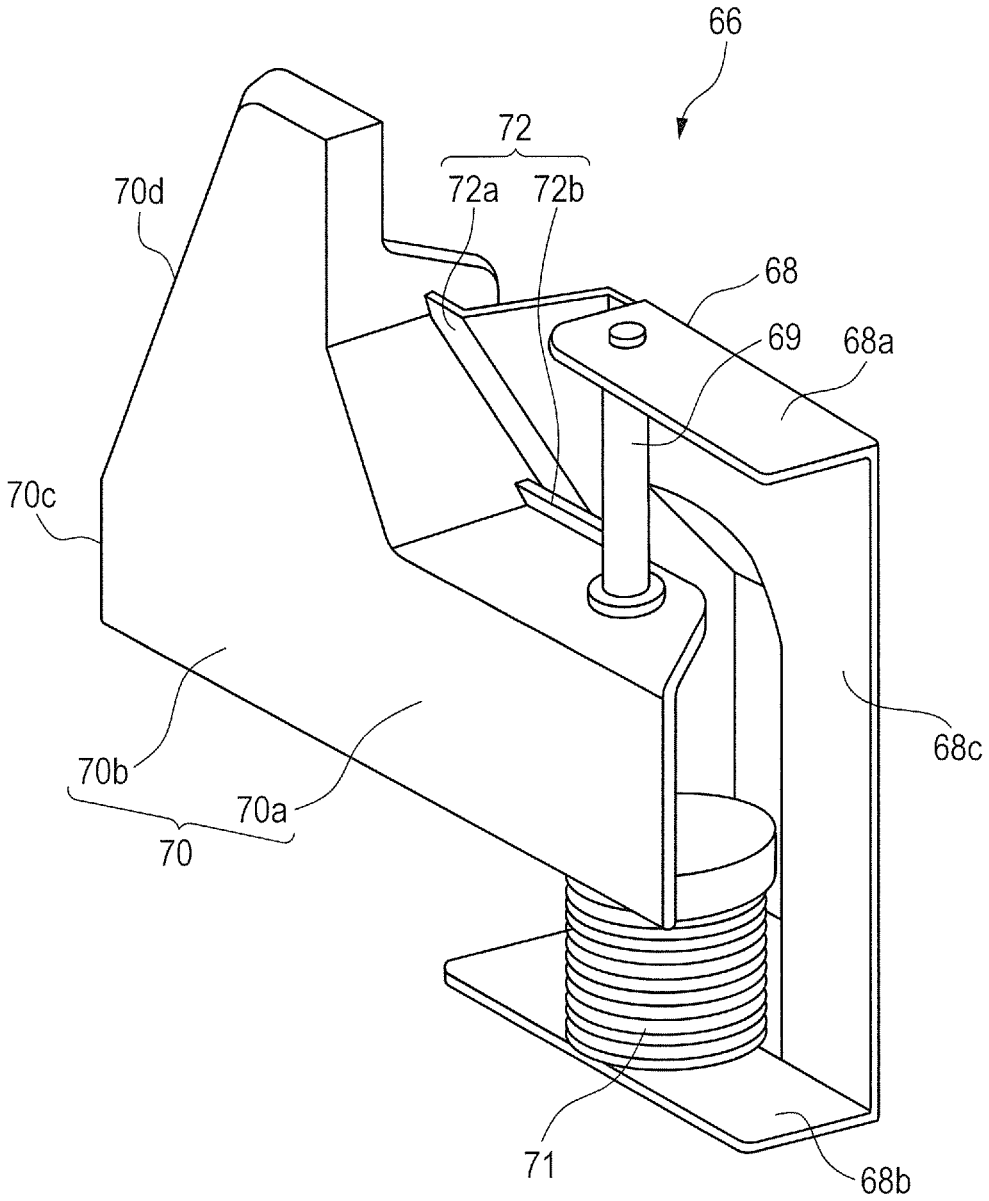
FIG. 5 is an enlarged perspective view of the pressing apparatus in a retracted state.
Figure 6:
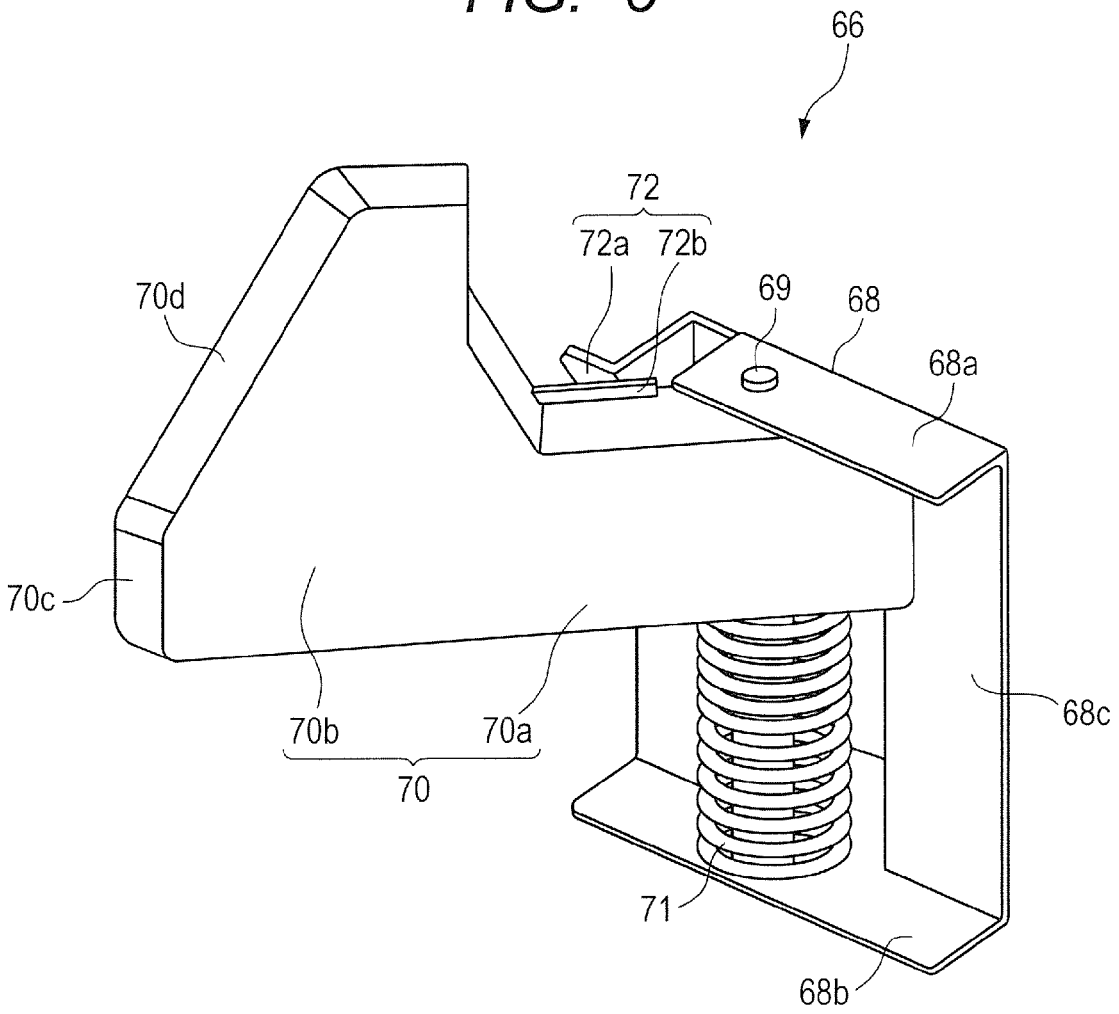
FIG. 6 is an enlarged perspective view of the pressing apparatus in a projected state.

With reference to FIG. 5 and FIG. 6, the pressing apparatus 66 includes a bracket 68 having end portions 68*a* and 68*b* both bent to face each other, a turn shaft 69 mounted to bridge both the end portions 68*a* and 68*b* bent at the top and bottom of the bracket 68, the pressing member 70 supported so that a proximal end portion thereof can be turned about the turn shaft 69 between a retracted position (first position) (see FIG. 5) and a projected position (second position) (see FIG. 6), and an urging member 71 configured to urge the pressing member 70 to turn about the turn shaft 69 toward the projected position. According to the embodiment, the pressing apparatus 66 is provided in the sheet feeding apparatus 5, and the retracted position is a position at which a distal end portion of the pressing member 70 is retracted toward the sheet feeding apparatus 5, and the projected position is a position at which the distal end portion of the pressing member 70 is projected toward the image forming apparatus 2.

The pressing member 70 at the retracted position is accommodated into an apparatus in which the pressing apparatus 66 is provided in a state in which the pressing member 70 is in contact with the side portion of the other apparatus, and the pressing member 70 at the projected position is projected from the apparatus in which the pressing apparatus 66 is provided.

Therefore, when the connection between the image forming apparatus 2 and the sheet feeding apparatus 5 is released, the pressing apparatus 70 urged by the urging member 71 turns from the retracted position toward the projected position to exert a force to separate the image forming apparatus 2 and the sheet feeding apparatus 5 from each other, thereby enabling a user to perform a separating operation with less force of the user than a case where the pressing apparatus 66 is not used, or without using a force of the user. In other words, the pressing apparatus 66 is configured to generate a force in the direction in which the image forming apparatus 2 and the sheet feeding apparatus 5 are separated from each other.

According to the embodiment, the pressing member is arranged below the feeding outlet 18 at the side portion of the sheet feeding apparatus 5 facing the image forming apparatus 2, and the bracket 68 is mounted on the housing 50 of the sheet feeding apparatus 5 so that the turn shaft 69 extends substantially in the vertical direction (vertically). Further, the pressing member 70 is turnable about the turn shaft 69 between the second position at which the pressing member 70 projects from the side portion of the sheet feeding apparatus 5 toward the image forming apparatus 2, and the first position at which the pressing member 70 is accommodated into the side portion of the sheet feeding apparatus 5, and the pressing member 70 is urged by the urging member 71 to turn toward the image forming apparatus 2.

Further, in the pressing apparatus 66 according to the embodiment, the pressing member 70 is vertically movable along the turn shaft 69, and the pressing apparatus 66 includes an urging unit which urges the pressing member 70 at all times to move upward along the turn shaft 69. The urging unit includes a coil spring serving as the urging member 71, and the pressing apparatus 66 further includes a deflection mechanism 72 configured to turn the pressing member 70 about the turn shaft 69 along with movement of the pressing member 70 along the turn shaft 69.

Further, the pressing member 70 includes a support portion 70*a* located at the proximal end portion side and supported to be turnable about the turn shaft 69, and a contact portion 70*b* located at the distal end portion (end portion opposite to the turn shaft 69) of the support portion 70*a*, and projecting and extending upward from the support portion 70*a* (in other words, toward the feeding outlet 18). The coil spring for use as the urging member 71 is arranged between the lower end portion 68*b* which is bent in the bracket 68 and a bottom surface of the support portion 70*a* of the pressing member 70. The coil spring is arranged to expand and contract in directions intersecting with a separating direction. With this, the urging member can generate an urging force in the direction intersecting with the separating direction. Therefore, a space for arrangement of the urging member 71 in the separating direction can be reduced. According to the embodiment, the coil spring is arranged so as to expand and contract in the longitudinal directions perpendicular to the separating direction. However, the coil spring may be arranged so as to expand and contact in horizontal directions perpendicular to the separating direction in a case where a structure of the pressing apparatus 66 is modified.

As the urging member 71, for example, a leaf spring bent into an L shape or a torsion spring can be used. The pressing apparatus 66 is arranged below the feeding outlet 18 at the side portion of the sheet feeding apparatus 5 facing the image forming apparatus 2, and the bracket 68 is mounted on the housing 50 of the sheet feeding apparatus 5 so that the turn shaft 69 extends vertically. Further, the pressing member 70 at the retracted position is accommodated into the sheet feeding apparatus 5 in a state in which the pressing member 70 is in contact with the openable and closable cover 22 of the image forming apparatus 2, whereas the pressing member 70 at the projected position is projected from the side portion of the sheet feeding apparatus 5.

Figure 9:
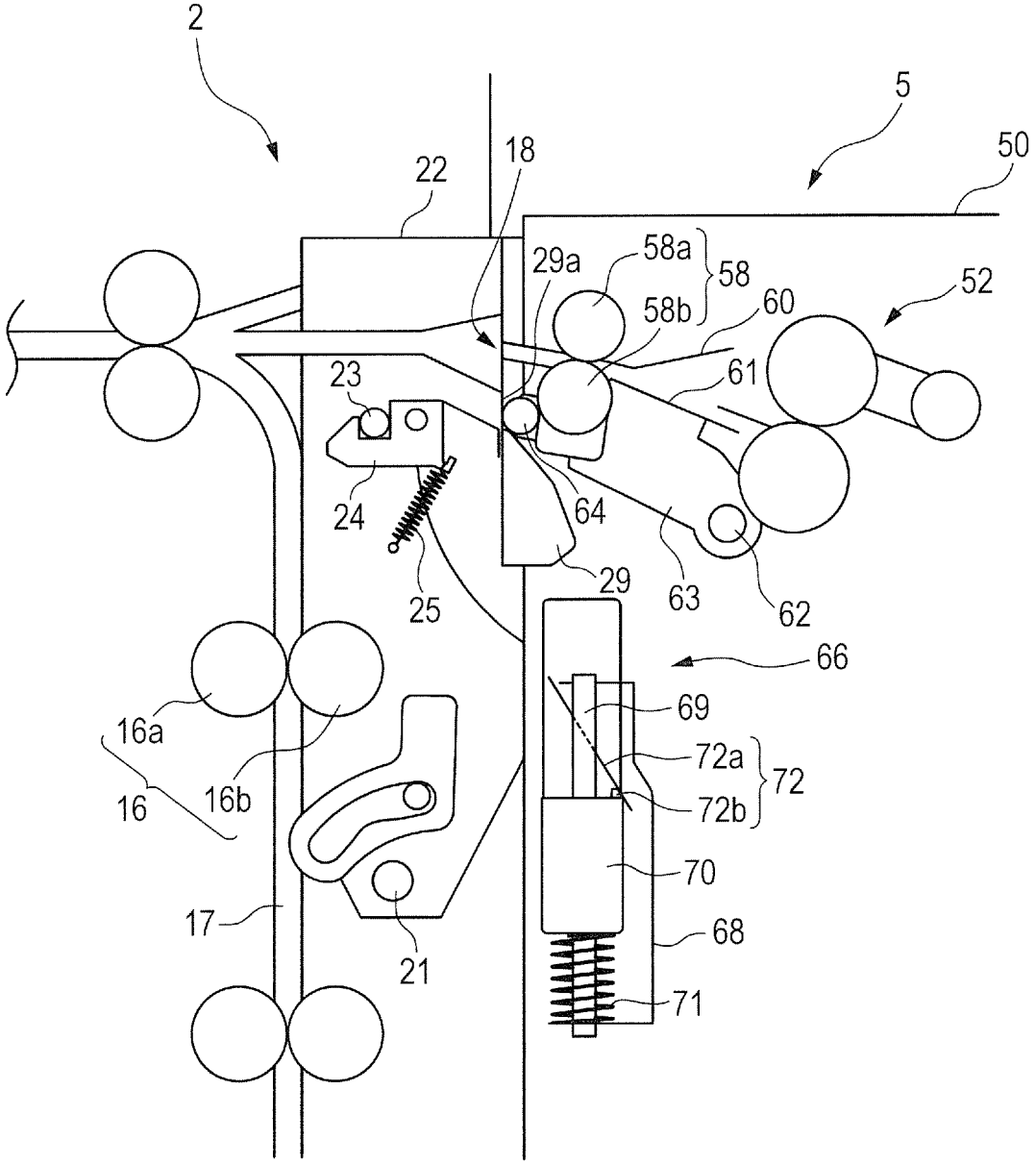
FIG. 9 is an explanatory view for illustrating a state in which the image forming apparatus and the sheet feeding apparatus are connected to each other.
Figure 10:
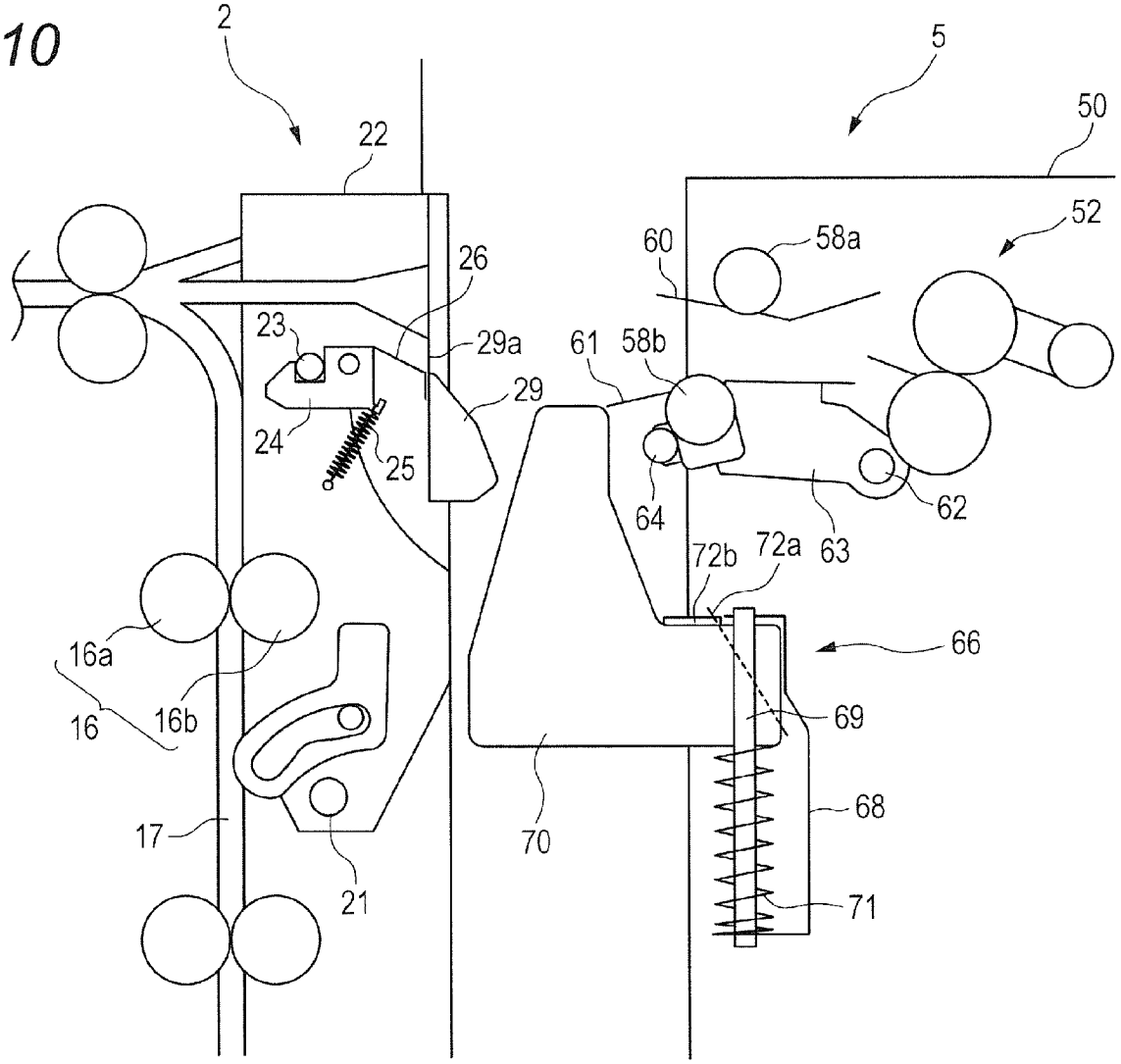
FIG. 10 is an explanatory view for illustrating a state in which the sheet feeding apparatus is separated from the image forming apparatus using the pressing apparatus.

In other words, in the state in which the image forming apparatus 2 and the sheet feeding apparatus 5 are connected to each other as illustrated in FIG. 9, the pressing member 70 is pressed by the side portion of the image forming apparatus 2 to be moved to the retracted position against the urging force of the urging member 71. When the image forming apparatus 2 and the sheet feeding apparatus 5 are separated from each other as illustrated in FIG. 10, the pressing member 70 is not pressed by the side portion of the image forming apparatus 2, and is moved to the projected position by the urging force of the urging member 71.

The urging force of the urging member 71 is determined to generate torque larger than torque about the turn shaft 69 acting on the pressing member 70 from the openable and closable cover 22 when the sheet feeding apparatus 5 is caused to approach to the image forming apparatus 2 to cause the pressing member 70 at the projected position to come into contact with the openable and closable cover 22.

Further, the pressing member 70 includes a vertical surface 70*c* formed at an end portion of the contact portion 70*b* facing the openable and closable cover 22 at the contact portion 70*b* and extending substantially in the vertical direction (vertically), and the inclined surface 70*d* facing upward and formed adjacent to the vertical surface 70*c* at the contact portion 70*b*.

Figure 11:
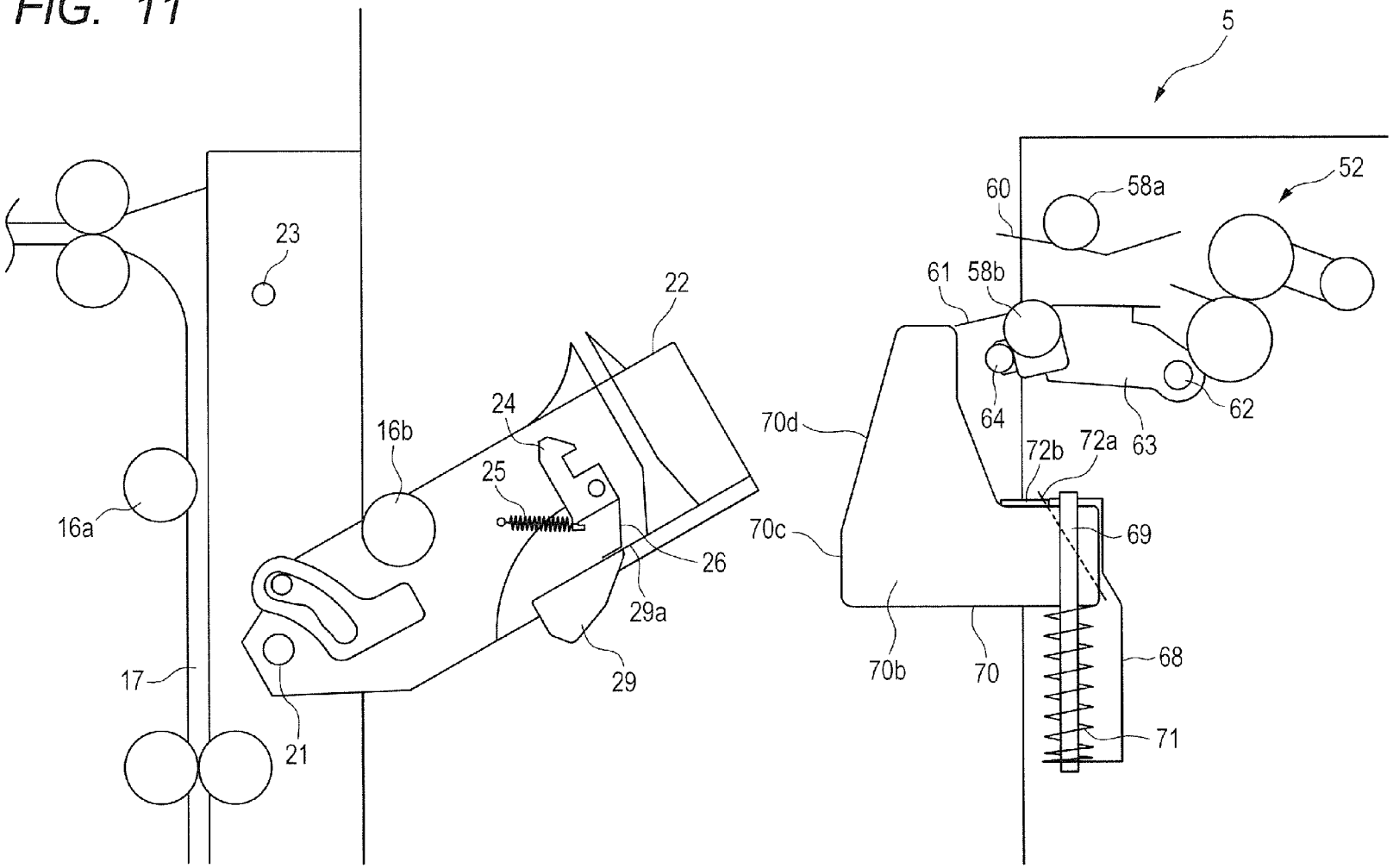
FIG. 11 is an explanatory view for illustrating a state in which the openable and closable cover of the image forming apparatus is opened in a state in which the sheet feeding apparatus is separated from the image forming apparatus.

The inclined surface 70*d* of the pressing member is formed to come into contact with the upper end portion (extremity portion) of the openable and closable cover 22 when the sheet feeding apparatus 5 is caused to approach to the image forming apparatus 2 in a state in which the openable and closable cover 22 is turned to the open position when the pressing member 70 is moved to the projected position, as illustrated in FIG. 11. Therefore, when the upper end portion of the openable and closable cover 22 at the open position comes into contact with the inclined surface 70*d* of the pressing member 70 through an operation of causing the sheet feeding apparatus 5 to approach to the image forming apparatus 2, as a result of the approaching operation of the sheet feeding apparatus 5, the upper end portion of the openable and closable cover 22 is slid upward along the inclined surface 70*d* to cause the openable and closable cover 22 to turn about the opening and closing turn shaft 21 toward the image forming apparatus 2 and further turn to the closed position with the vertical surface 70*c* of the pressing member 70.

The deflection mechanism 72 includes a deflecting member 72*a* provided on the bracket 68 mounted to the sheet feeding apparatus 5 so as to face the image forming apparatus 2 side and having a cam surface formed by a downwardly inclined surface, and a cam contact portion 72*b* formed on top of the support portion 70*a* of the pressing member 70. The pressing member 70 is vertically movable along the turn shaft 69 in a state in which the cam contact portion 72*b* formed on the support portion 70*a* is pressed by the urging member 71 against the cam surface of the deflecting member 72*a* provided on the bracket 68. According to the embodiment, the bracket 68 and the deflecting member 72*a* are integrally formed with each other. In other words, the deflection mechanism 72 is configured to move the pressing member 70 in the separating direction while being in contact with the pressing member 70 which is moved upward by an upward force from the urging member 71.

In the pressing apparatus 66 having the deflection mechanism 72 configured as described above, the pressing member 70 is moved to the lower side (side to which the coil spring is compressed) of the turn shaft 69 against the urging force of the urging member 71. With this, the cam contact portion 72*b* moves downward along the cam surface of the deflecting member 72*a* to cause the pressing member 70 to turn about the turn shaft 69 toward the sheet feeding apparatus 5 to be moved to the first position at which the pressing member 70 is to be accommodated into the sheet feeding apparatus 5, as illustrated in FIG. 5.

Meanwhile, the pressing member 70 is moved from the retracted position to the upper side (side to which the coil spring is expanded) along the turn shaft 69 with the urging force of the urging member 71. Along with the upward movement of the pressing member 70, the cam contact portion 72*b* moves upward along the cam surface of the deflecting member 72*a* to cause the pressing member 70 to be pushed out toward the image forming apparatus 2 (in the direction away from the sheet feeding apparatus 5) while turning about the turn shaft 69, thereby being moved, as illustrated in FIG. 6, to the second position at which the pressing member 70 is to be projected toward the image forming apparatus 2.

Further, an upper end of the support portion 70*a* of the pressing member 70 reaches and comes into contact with the upper end portion 68*a* bent in the bracket 68 to stop the upward movement of the support portion 70*a*, and the end portion on the proximal end side of the support portion 70*a* comes into contact with a planar portion 68*c* of the bracket 68 to stop also turning of the pressing member about the turn shaft 69. In other words, a turning angle range of the pressing member 70 is regulated by the planar portion 68*c* of the bracket 68. It is preferred that the turning angle of the pressing member 70 from the first position to the second position be less than 90° and that the pressing member 70 at the second position form an acute angle with the side portion of the sheet feeding apparatus 5. With this, the pressing member 70 at the projected position forms an acute angle with the side surface of the sheet feeding apparatus 5. Thus, when the pressing member at the projected position is pressed against the openable and closable cover 22, the pressing member 70 smoothly turns to the retracted position.

Further, according to the above-mentioned embodiment, the pressing apparatus 66 is provided in the sheet feeding apparatus 5 but may be provided in the image forming apparatus 2.

Further, in the pressing apparatus 66 configured as described above, when the pressing member 70 turns to the projected position, as illustrated in FIG. 11, the contact portion 70*b* of the pressing member 70 is positioned closer to the image forming apparatus 2 than the extremity (side projected outward from the sheet feeding apparatus 5) of the lower guide 61 and the guiding roller 64 when the guide block 63 turns to the open position, and an upper end of the contact portion 70*b* is lifted to a height beyond the extremity of the lower guide 61 and the guiding roller 64. With this, in a case where the image forming apparatus 2 and the sheet feeding apparatus 5 are caused to approach to each other for connection in a state in which the openable and closable cover 22 is turned to the closed position, the side portion (more specifically the openable and closable cover 22) of the image forming apparatus 2 comes into contact with the pressing member 70 before the lower guide 61 and the guiding roller 64 of the sheet feeding apparatus 5, and collision impact is reduced due to the urging force of the urging member 71.

The pressing member 70 protects the openable and closable cover 22 from coming into contact with the lower guide 61 and the guiding roller 64. Further, also in a case where the image forming apparatus 2 and the sheet feeding apparatus 5 are caused to approach to each other for connection in a state in which the openable and closable cover 22 is turned to the open position, the openable and closable cover 22 comes into contact with the contact portion 70*b* of the pressing member 70 before the lower guide 61 and the guiding roller 64, and hence the upper end portion of the openable and closable cover 22 at the open position is prevented from directly coming into collision with the lower guide 61 and the guiding roller 64. Therefore, the effect of protecting the lower guide 61 and the guiding roller 64 from deformation and damage caused by the side portion of the image forming apparatus 2 and the openable and closable cover 22 is achieved.

Figure 7:
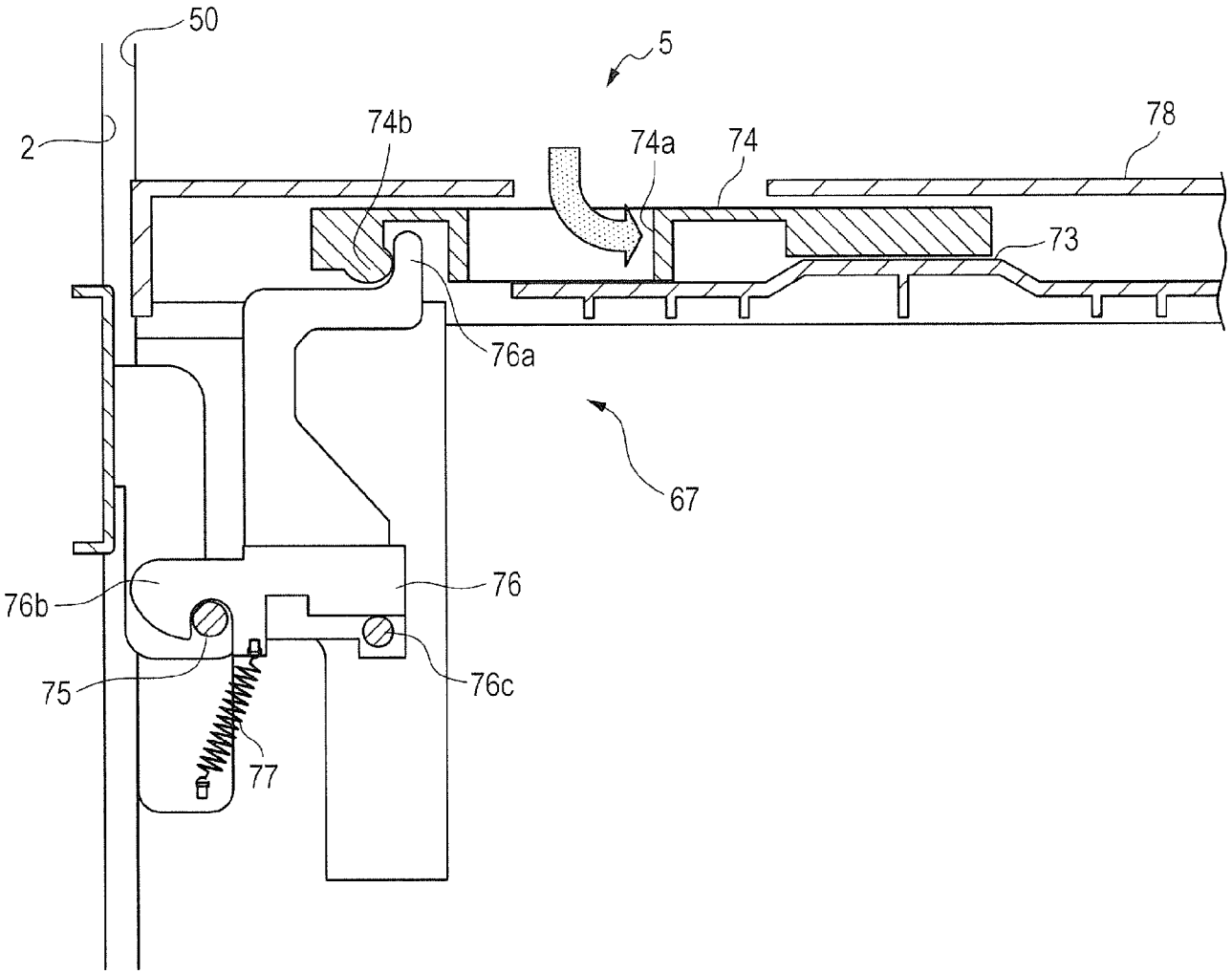
FIG. 7 is a partial sectional view for illustrating a connecting and holding mechanism at a locked position.
Figure 8:
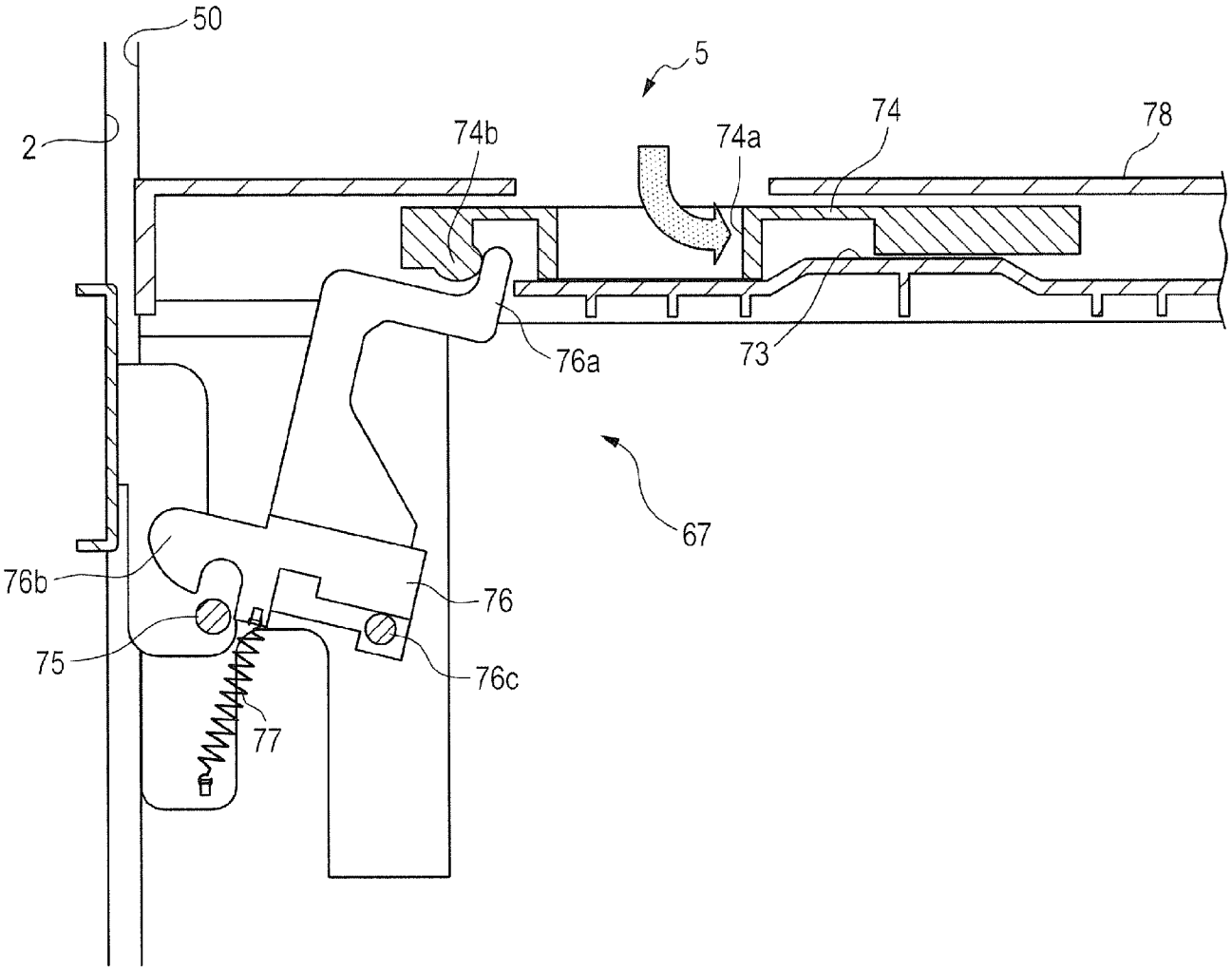
FIG. 8 is a partial sectional view for illustrating the connecting and holding mechanism at an unlocked position.

The connecting and holding mechanism 67 is arranged on top of one end portion (more specifically, an end portion on an operator side) in the sheet width direction perpendicular to a sheet feeding direction in the sheet feeding apparatus 5. With reference to FIG. 7 and FIG. 8, the connecting and holding mechanism 67 includes an operating member 74 capable of sliding along a guiding portion 73 formed on top of the housing 50 of the sheet feeding apparatus 5, a locking claw 76 supported by a turn shaft 76*c* to be turnable between an engaged position at which the locking claw 76 is engaged with a locking pin 75 and a disengaged position at which the locking claw 76 is disengaged from the locking pin 75, and an urging member 77 configured to urge the locking claw 76 to turn in a direction toward the engaged position. The urging member 77 is suitably a tension spring, for example.

The locking pin 75 is provided to be projected from the side portion of the image forming apparatus 2 which faces the sheet feeding apparatus 5, and is engaged with the locking claw 76 in a mode of being inserted into the sheet feeding apparatus 5 when the sheet feeding apparatus 5 is connected to the image forming apparatus 2.

The operating member 74 includes an operating portion 74*a* exposed from an opening portion formed in an upper cover 78 of the sheet feeding apparatus 5, and an engaging portion 74*b* formed at the extremity portion of the operating member 74. The operating member 74 is slid along the guiding portion 73 through manual operation of the operating portion 74*a* by the operator.

An operation of disengaging the locking pin 75 and the locking claw 76 will be described. The engaging portion 74*b* is engaged with an operating lever portion 76*a* formed at the locking claw 76. When the operating member 74 is slid in a rightward direction (direction opposite to the sheet conveying direction), as illustrated in FIG. 8, the operating lever portion 76*a* is pushed clockwise about the turn shaft 76*c* by the engaging portion 74*b* to turn the locking claw 76 toward the disengaged position against the urging member 77, thereby disengaging the locking claw 76 from the locking pin 75. The turn shaft 76*c* extends in a direction intersecting with a predetermined plane extending in the sheet conveying direction and in the vertical direction.

Next, an operation of connecting the locking pin 75 and the locking claw 76 to each other will be described. The sheet feeding apparatus 5 is moved in a direction of connecting to the image forming apparatus 2 to cause an extremity portion 76*b* of the locking claw 76 to come into contact with the locking pin 75 to turn the locking claw 76 in a clockwise direction in FIG. 8 against a force of the urging member 77.

With this, the extremity portion 76*b* of the locking claw 76 goes over the locking pin 75 to cause a recessed portion of the locking claw 76 to be fitted onto the locking pin 75, thereby bringing the locking claw 76 into engagement with the locking pin 75.

It is preferred that a set including the locking pin 75, the locking claw 76, and the urging member 77 be arranged in each end portion in the sheet width direction of the sheet feeding apparatus 5. In this case, the turn shaft 76*c* is provided so as to extend in the sheet width direction, and the locking claws 76 at both end portions on the front side and the rear side are connected by the turn shaft 76*c*. With this, the locking claw 76 on each side in the sheet width direction can be disengaged from the corresponding locking pin 75 through an operation of the front side operating member 74.

As described above, at the retracted position, the pressing member 70 of the pressing apparatus 66 is urged by the urging member 71 to turn toward the projected position in the state in which the pressing member 70 is in contact with the openable and closable cover 22 of the image forming apparatus 2. In other words, in the state in which the sheet feeding apparatus 5 is connected to the image forming apparatus 2, the urging force of the urging member 71 causes a force of separating the sheet feeding apparatus 5 from the image forming apparatus 2 to act on the openable and closable cover 22 of the image forming apparatus 2. The connecting and holding mechanism 67 thus performs a function of keeping the image forming apparatus 2 and the sheet feeding apparatus 5 in a connected state against the force of separating the sheet feeding apparatus 5 from the image forming apparatus 2 which is generated by the pressing member 70.

Next, an operation of separating the image forming apparatus 2 and the sheet feeding apparatus 5 from each other in the image forming system 1 illustrated in FIG. 1 will be described with reference to FIG. 9 to FIG. 11.

In the state in which the image forming apparatus 2 and the sheet feeding apparatus 5 are connected to each other in the image forming system 1, at the engaged position, the locking claw 76 of the connecting and holding mechanism 67 mounted on the sheet feeding apparatus 5 is engaged with the locking pin 75 projected from the side portion of the image forming apparatus 2 and inserted into the sheet feeding apparatus 5, thereby keeping a connected state of the image forming apparatus 2 and the sheet feeding apparatus 5 against the force of separating the image forming apparatus 2 and the sheet feeding apparatus 5 from each other that is generated by the pressing member 70 of the pressing apparatus 66.

When the image forming apparatus 2 and the sheet feeding apparatus 5 are kept in the connected state, as illustrated in FIG. 9, the pressing member 70 of the pressing apparatus 66 is pressed by the sheet feeding apparatus 5 toward the side portion of the image forming apparatus 2 to be moved to the retracted position in a state in which the pressing member 70 is in contact with the side portion of the image forming apparatus 2. The pressing member 70 at the retracted position is urged to be turned about the turn shaft 69 by the urging member 71 toward the image forming apparatus 2, and hence at that time, the pressing member 70 exerts a force on the image forming apparatus 2 in the direction of separating the sheet feeding apparatus 5 from the image forming apparatus 2.

In the state in which the image forming apparatus 2 and the sheet feeding apparatus 5 are connected to each other, when the operating member 74 is slid along the guiding portion 73 by the operating portion 74*a* of the operating member 74 exposed from the opening portion formed in the upper cover 78 of the sheet feeding apparatus 5, the locking claw 76 is turned toward the disengaged position through an engagement between the engaging portion 74*b* of the operating member 74 and the operating lever portion 76*a* of the locking claw 76, thereby disengaging the locking claw 76 from the locking pin 75. With this, the sheet feeding apparatus 5 is disconnected from the image forming apparatus 2, and the urging force of the urging member 71 acts on the image forming apparatus 2 through the pressing member 70 in this state, thereby enabling the sheet feeding apparatus 5 to be moved with respect to the image forming apparatus 2.

When the sheet feeding apparatus 5 and the image forming apparatus 2 connected and held by the connecting and holding mechanism 67 are disconnected as described above, the pressing member 70 is released from the fixed pressing caused by the side portion of the image forming apparatus 2. With this, as illustrated in FIG. 10, the pressing member 70 is moved upward along the turn shaft 69 with the urging force of the urging member 71, and the cam contact portion 72*b* is moved upward along the cam surface of the deflecting member 72*a* in association with the movement of the pressing member 70, thereby causing the pressing member 70 to turn about the turn shaft 69 toward the projected position.

As a result, the movable sheet feeding apparatus 5 moves in the direction of separating from the fixed image forming apparatus 2 along the guide rail 65. Further, when the sheet feeding apparatus 5 and the image forming apparatus 2 connected and held by the connecting and holding mechanism 67 are disconnected, as described above, the sheet feeding apparatus 5 automatically moves away from the image forming apparatus 2, which eliminates the need to keep the state in which the operating member 74 of the connecting and holding mechanism 67 is moved to the direction of disconnection. Thus, a configuration of the connecting and holding mechanism 67 can be simplified, and an operation of moving the sheet feeding apparatus 5 can be performed by a hand placed on the connecting surface of the sheet feeding apparatus 5.

Therefore, the operator can be assisted in performing the operation of separating the sheet feeding apparatus 5 from the image forming apparatus 2, thereby facilitating the separating operation. Further, the pressing member 70 having a configuration to turn about the turn shaft 69 may suppress the size of the pressing apparatus 66 in the separating direction as compared to an apparatus in which a member pressing against the image forming apparatus 2 is slidable in the separating direction (referred to as "apparatus A"). This is because, in a case where the stroke for pressing against the image forming apparatus 2 is the same, the apparatus in which the pressing member 70 turns may allow the pressing member 70 to be retracted into a space of the sheet feeding apparatus which extends in the direction intersecting with the predetermined surface extending in the sheet conveying direction and in the vertical direction, and hence the size in the separating direction can be suppressed as compared to the apparatus A.

Even in a case where the urging force of the urging member 71 is not sufficient to move the sheet feeding apparatus 5 with respect to the image forming apparatus 2, the urging member 71 urges the pressing member to exert a force in the direction of separating the sheet feeding apparatus 5 from the image forming apparatus 2, thereby being capable of reducing a force necessary for the operator to separate the sheet feeding apparatus 5 from the image forming apparatus 2.

When the sheet feeding apparatus 5 is separated from the image forming apparatus 2, the openable and closable cover 22 of the image forming apparatus 2 is separated from the guiding roller 64, and the guiding roller 64 mounted on the extremity portion of the guide block 63 is removed from the regulating portion 29*a* of the openable and closable cover 22.

With this, an assembly including the guide block 63, the lower guide 61, the driven roller 58*b* of the conveyance roller pair 58, and the guiding roller 64 turns downward about the block turn shaft 62 under its own weight to separate the lower guide 61 and the driven roller 58*b* from the upper guide 60 and the driving roller 58*a*, thereby opening the feeding outlet 18 widely.

Therefore, removal of sheets jammed in the conveyance path of the separating and feeding mechanism 52 is facilitated. Further, when the sheet feeding apparatus is separated from the image forming apparatus 2, the guide block 63 turns downward about the block turn shaft 62 toward the open position to separate the driven roller 58*b* from the driving roller 58*a*. Thus, a sheet is not damaged even when the sheet feeding apparatus 5 is separated from the image forming apparatus 2 in a state in which the sheet is nipped between the driving roller 58*a* and the driven roller 58*b*.

In the state in which the sheet feeding apparatus 5 is thus separated from the image forming apparatus 2, as illustrated in FIG. 11, the openable and closable cover 22 arranged at the side portion of the image forming apparatus 2 can be turned to the open position to open the cassette conveyance path 17.

When the openable and closable cover 22 is to be turned to the open position, the handle 26 is lifted up to turn the locking claw 24 against the urging force of the urging spring 25, thereby disengaging the locking claw 24 from the locking pin 23. Thus, the openable and closable cover 22 is turned outward (toward the sheet feeding apparatus 5) about the opening and closing turn shaft 21. The openable and closable cover 22 is thus opened to open the cassette conveyance path 17, thereby facilitating removal of sheets jammed in the cassette conveyance path 17.

When the sheet feeding apparatus 5 is to be connected to the image forming apparatus 2, in order to prevent damage to the lower guide 61 and the like caused by the openable and closable cover 22, the openable and closable cover 22 is turned about the opening and closing turn shaft 21 toward the image forming apparatus 2 until an extremity portion of the locking claw 24 goes over the locking pin 23 to bring the locking pin 23 and the locking claw 24 into engagement with each other again to close the openable and closable cover 22. Then, the sheet feeding apparatus 5 is caused to approach to the image forming apparatus 2.

The pressing apparatus 66 and the image forming system 1 using the pressing apparatus 66 are described above with reference to the illustrated embodiment. However, the present invention is not limited to the illustrated embodiment.

For example, the pressing member 70 is provided on the movable sheet feeding apparatus 5 side in the illustrated embodiment but may be provided on the fixed image forming apparatus 2 side. Further, the turn shaft 69 extends in the vertical direction (substantially vertically) in the illustrated embodiment but may extend, for example, in the horizontal direction as long as the pressing member 70 is urged to turn toward the image forming apparatus 2 to allow a force in the direction of separating the sheet feeding apparatus 5 from the image forming apparatus 2 to be exerted.

Further, the coil spring is used as the urging member 70, but a spring of another type can also be used.

In addition, in the above-mentioned embodiment, there is illustrated an example in which the pressing apparatus 66 is employed in the image forming system 1 including the image forming apparatus 2 and the sheet feeding apparatus 5. However, as a matter of course, the pressing apparatus 66 of the present invention can be applied not only to the image forming system but also to any system including two or more apparatus or units capable of being connected and separated.

Next, with reference to FIG. 12A to FIG. 12D, there will be described an operation of connecting the image forming apparatus 2 and the sheet feeding apparatus 5 to each other in the image forming system 1 illustrated in FIG. 1 in a state in which the openable and closable cover 22 of the image forming apparatus 2 is opened.

In the state in which the image forming apparatus 2 and the sheet feeding apparatus 5 are separated from each other, the openable and closable cover 22 of the image forming apparatus 2 does not press the pressing member 70 of the sheet feeding apparatus 5, and the regulating portion 29*a* provided on the openable and closable cover 22 does not support the guiding roller 64.

Figure 12A:
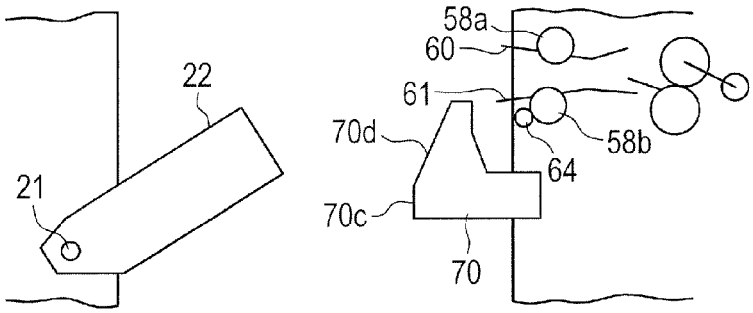
FIG. 12A, FIG. 12B, FIG. 12C, and FIG. 12D are explanatory views for illustrating an operation of a closing apparatus for the openable and closable cover when, in the image forming system illustrated in FIG. 1, the sheet feeding apparatus is to be connected to the image forming apparatus in a state in which the openable and closable cover is opened.

Therefore, as illustrated in FIG. 12A, the pressing member 70 is turned to the projected position by the urging force of the urging member 71, and the guide block 63 is turned downward to the open position about the block turn shaft 62 under its own weight.

Figure 12B:
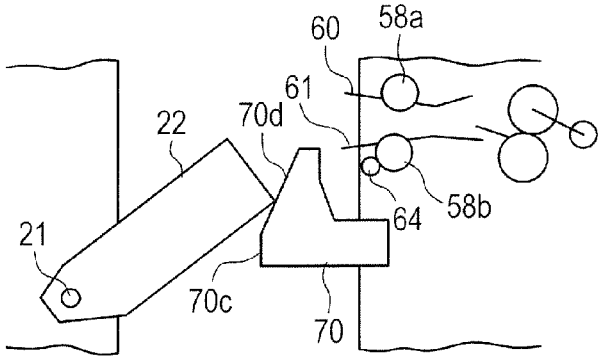

When the sheet feeding apparatus 5 is caused to approach to the image forming apparatus 2 to be connected to the image forming apparatus 2 from the state in which the image forming apparatus 2 and the sheet feeding apparatus 5 are separated from each other and in which the openable and closable cover 22 is at the open position as illustrated in FIG. 12A, a corner portion at the upper end (extremity) of the openable and closable cover 22 at the open position comes into contact with the inclined surface 70*d* of the pressing member 70 at the projected position, as illustrated in FIG. 12B.

Figure 12C:
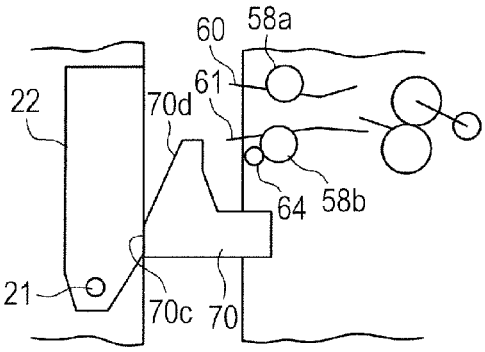

The urging force of the urging member 71 is determined to generate torque larger than torque about the turn shaft 69 acting on the pressing member 70 from the openable and closable cover 22 when the sheet feeding apparatus 5 is caused to approach to the image forming apparatus 2 to cause the pressing member 70 at the projected position to come into contact with the openable and closable cover 22 at the open position. In other words, even when the corner portion at the upper end of the openable and closable cover 22 comes into contact with the inclined surface 70*d* of the pressing member 70, the pressing member 70 presses the openable and closable cover 22 toward the image forming apparatus 2 while keeping the projected position. Thus, when the sheet feeding apparatus is further caused to approach to the image forming apparatus 2 from the state in which the corner portion at the upper end of the openable and closable cover 22 is held in contact with the inclined surface 70*d* of the pressing member 70, the corner portion at the upper end of the openable and closable cover 22 slides upward along the inclined surface 70*d*, and the openable and closable cover 22 turns about the opening and closing turn shaft 21 toward the image forming apparatus 2 in association with the sliding of the corner portion. Further, as illustrated in FIG. 12C, the vertical surface 70*c* of the pressing member 70 comes into contact with the openable and closable cover 22, and the openable and closable cover 22 is pressed by the vertical surface 70*c* of the pressing member 70 along with the approaching operation of the sheet feeding apparatus 5 with respect to the image forming apparatus 2 to be brought into the closed position.

At that time, the pressing member 70 presses the openable and closable cover 22 to cause the locking claw 24 to turn from the locked position against the urging force of the urging spring 25 and go over the locking pin 23, thereby bringing the locking claw 24 and the locking pin 23 into engagement with each other to hold the openable and closable cover 22 at the closed position. In other words, the urging force of the urging member 71 is determined to generate torque larger than torque about the turn shaft 69 acting on the pressing member 70 from the openable and closable cover 22 when the locking claw 24 and the locking pin 23 are to be brought into engagement with each other.

Even when the sheet feeding apparatus 5 is caused to approach to the image forming apparatus 2 with the openable and closable cover 22 kept turned to the open position, the openable and closable cover 22 is turned to the closed position and held at the closed position by the pressing member 70 brought automatically into the projected position when the sheet feeding apparatus 5 is separated from the image forming apparatus 2. Thus, the upper end portion of the openable and closable cover 22 at the open position can be prevented from coming into contact with the side portion (particularly the upper guide 60 and the lower guide 61) of the sheet feeding apparatus to cause deformation and damage of the openable and closable cover 22, the upper guide 60, and the lower guide 61.

The contact portion 70*b* of the pressing member 70 at the projected position is positioned closer to the image forming apparatus 2 than the extremity (side projected outward from the sheet feeding apparatus 5) of the lower guide 61 and the guiding roller 64 when the guide block 63 is turned to the open position, and the upper end of the contact portion 70*b* is lifted to a height beyond the extremity of the lower guide 61 and the guiding roller 64. In other words, when the pressing member 70 is turned to the projected position, the pressing member 70 is located between the openable and closable cover 22 at the open position, and the extremity of the lower guide 61 and the guiding roller 64. Thus, even when the sheet feeding apparatus 5 is caused to approach to the image forming apparatus 2 in a state in which the openable and closable cover 22 is at the open position, the openable and closable cover 22 does not come into contact with the lower guide 61 or the guiding roller 64, thereby preventing damage of the openable and closable cover 22 due to a direct collision with the lower guide 61 or the guiding roller 64.

When the sheet feeding apparatus 5 is further caused to approach to the image forming apparatus 2 from a state in which the openable and closable cover 22 is held at the closed position, the pressing member 70 is pressed from the openable and closable cover 22 toward the sheet feeding apparatus 5 through the vertical surface 70*c*. With this, the pressing member 70 is turned about the turn shaft from the projected position toward the sheet feeding apparatus 5 against the urging force of the urging member 71. Concomitantly therewith, the cam contact portion 72*b* formed on the support portion 70*a* of the pressing member 70 moves downward along the cam surface of the deflecting member 72*a* provided on the bracket 68 mounted on the sheet feeding apparatus 5 to move the pressing member 70 downward along the turn shaft 69 against the urging force of the urging member 71.

The pressing member 70 thus moves downward along the turn shaft 69 through an approaching operation of the sheet feeding apparatus 5 toward the image forming apparatus 2 while turning about the turn shaft 69, thereby moving from the projected position to the retracted position. With this, the pressing member 70 can be moved to the retracted position without coming into contact with the lower guide 61 or the guiding roller 64. A force of moving the openable and closable cover 22 to the closed position can be reduced by pressing the openable and closable cover 22 by the vertical surface 70*c* of the pressing member 70.

Further, when the sheet feeding apparatus 5 is further caused to approach to the image forming apparatus 2 in the state in which the openable and closable cover 22 is held at the closed position, the guiding roller 64 mounted to the extremity portion of the guide block 63 turned to the open position comes into contact with the upwardly inclined surface of the leading guide 29 provided on the openable and closable cover 22, thereby being guided upward.

With this, the guide block 63 having turned to the open position under its own weight turns upward about the block turn shaft 62. Further, in the state in which the sheet feeding apparatus 5 is connected to the image forming apparatus 2, the guiding roller 64 reaches the regulating portion 29*a* provided on the openable and closable cover 22 along the leading guide 29 to cause the guide block 63 to turn again to the operating position, thereby causing the guide block 63 to be held at the operating position in the state in which the extremity portion of the guide block 63 is supported on the regulating portion 29*a*.

As a result, the lower guide 61 mounted on the upper surface of the guide block 63 is arranged to be opposed to the upper guide 60 to form a conveyance path, and the driven roller 58*b* mounted on the guide block 63 is arranged to be opposed to the driving roller 58*a* to form the conveyance roller pair 58, thereby being capable of feeding sheets to the image forming apparatus 2 again.

Further, as described above, the sheet feeding apparatus 5 is caused to approach to the image forming apparatus 2 to cause the pressing member 70 to be brought into the retracted position and accommodated into the sheet feeding apparatus 5. Thus, the sheet feeding apparatus 5 can approach to the image forming apparatus 2 to be juxtaposed to the image forming apparatus 2.

At that time, along with the approaching operation of the sheet feeding apparatus 5 with respect to the image forming apparatus 2, the locking pin 75 provided to be projected from the side portion of the image forming apparatus 2 is inserted into the sheet feeding apparatus 5, and the locking claw 76 is turned so that the extremity portion 76*b* of the locking claw 76 goes over the locking pin 75 to bring the locking pin 75 and the locking claw 76 into engagement with each other, thereby holding the image forming apparatus 2 and the sheet feeding apparatus 5 in the connected state against the force with which the sheet feeding apparatus 5 is to be separated from the image forming apparatus 2 by the pressing member 70.

Figure 12D:
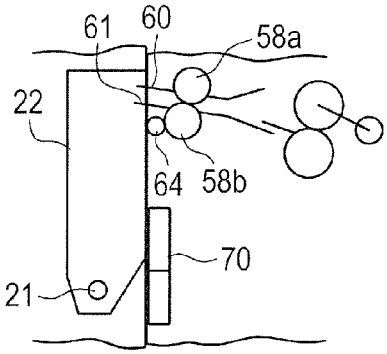

In such a manner, as illustrated in FIG. 12D, the image forming apparatus 2 and the sheet feeding apparatus 5 can be connected to each other.

According to above-mentioned embodiment, the pressing member 70 is urged to the projected position by the urging member 71. Thus, when the sheet feeding apparatus 5 (second unit) is separated from the image forming apparatus 2 (first unit), the pressing member 70 is turned about the turn shaft 69 to the projected position to be projected from the sheet feeding apparatus 5 toward the image forming apparatus 2, and hence the openable and closable cover 22 at the open position comes into contact with the pressing member 70 before the side portion of the sheet feeding apparatus 5 when the sheet feeding apparatus 5 is caused to approach to the image forming apparatus 2.

Further, in the urging member 71, such an urging force as to generate torque larger than torque about the turn shaft 69 acting on the pressing member 70 through contact with the openable and closable cover 22 at the open position is caused to act on the pressing member 70. Thus, the openable and closable cover 22 at the open position is pressed by the pressing member 70 toward the image forming apparatus 2 along with an approach of the sheet feeding apparatus 5 to the image forming apparatus 2, thereby being turned from the open position to the closed position. With this, the openable and closable cover 22 is closed.

When the sheet feeding apparatus 5 is further caused to approach to the image forming apparatus 2, the pressing member 70 is turned about the turn shaft 69 with a force from the image forming apparatus 2 against the urging force of the urging member 71 and moved to the retracted position to be accommodated into the sheet feeding apparatus 5.

Thus, the sheet feeding apparatus 5 can be connected to the side portion of the image forming apparatus 2 without being interfered by the pressing member 70. As described above, the pressing member 70 is configured to prevent the openable and closable cover 22 from being brought into contact with the conveyance path including the upper guide 60 and the lower guide 61 when the pressing member 70 is positioned in a region where the openable and closable cover 22 moves from the most open position to a position immediately before the closed position.

Further, the pressing member 70 has the inclined surface 70*d* formed to incline downward from the proximal end portion side toward the distal end side, and after the extremity portion of the openable and closable cover 22 comes into contact with the inclined surface 70*d*, the extremity portion of the openable and closable cover 22 moves up the inclined surface 70*d* while approaching to the sheet feeding apparatus 5 along with the approaching operation of the sheet feeding apparatus 5 with respect to the image forming apparatus 2. Thus, the openable and closable cover 22 smoothly turns toward the closed position, and the approaching operation of the sheet feeding apparatus 5 with respect to the image forming apparatus 2 is not hindered.

Further, a distal end surface of the pressing member 70 which comes into contact with the openable and closable cover 22 at the closed position is the vertical surface 70*c* extending substantially in the vertical direction. Thus, the vertical surface 70*c* comes into contact with and is pressed against the openable and closable cover 22 to securely turn the openable and closable cover 22 to the closed position. In addition, when the pressing member 70 is turned to the projected position, the contact portion 70*b* of the pressing member 70 is set to be located between the extremities of the upper guide 60 and the lower guide 61, and the openable and closable cover 22 at the open position. Thus, the openable and closable cover 22 at the open position is securely prevented from coming into collision with the upper guide 60, the lower guide 61, and the guiding roller 64.

Moreover, the urging member 71 and the deflecting member 72*a* are configured to turn the pressing member 70 horizontally while moving the pressing member 70 vertically. Thus, when the pressing member 70 is moved to the projected position and the retracted position, the pressing member 70 is prevented from coming into contact with the upper guide 60, the lower guide 61, and the guiding roller 64, thereby being capable of setting the projected position of the pressing member 70 to a position closer to the upper guide 60, the lower guide 61, and the guiding roller 64.

The present invention is not limited to the illustrated embodiment. For example, in the illustrated embodiment, the deflection mechanism 72 includes the cam surface of the deflecting member 72*a* having the inclined surface, and the cam contact portion 72*b* coming into contact therewith. However, the deflection mechanism 72 can also be achieved by screwing a screw thread formed on an outer peripheral surface of the turn shaft 69 into a screw groove formed in an inner peripheral surface of the support portion 70*a* of the pressing member 70.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-218895, filed Nov. 6, 2015, and Japanese Patent Application No. 2015-218896, filed Nov. 6, 2015, which are hereby incorporated by reference herein in their entirety.

What is claimed is:

1. A pressing apparatus configured to generate a force in a separating direction in which a first unit and a second unit being connected to each other are separated from each other, the pressing apparatus comprising:

a pressing portion configured to turn about a turn shaft and to press the first unit, a turning of the pressing portion about the turn shaft exerting the force on the first unit in the separating direction, the pressing portion being provided at the second unit, and an axial direction of the turn shaft intersecting with the separating direction;

a moving portion configured to turn the pressing portion about the turn shaft; and an urging portion configured to urge a part of the moving portion in the axial direction, an urging force of the urging portion performing a movement of the part of the moving portion in the axial direction, the movement causing the moving portion to turn the pressing portion about the turn shaft.

2. A pressing apparatus according to claim 1, wherein the moving portion comprises:

a cam surface configured to be inclined with respect to the turn shaft; and a cam contact portion configured to be in contact with the cam surface, the cam contact portion being provided on the part of the moving portion, and wherein the cam surface is formed to turn the pressing portion along with the movement of the part of the moving portion.

3. A pressing apparatus according to claim 1, wherein the pressing portion is supported by the turn shaft so as to be movable between a first position at which a distal end portion of the pressing portion is retracted to the second unit and a second position at which the distal end portion of the pressing portion is projected toward the first unit, and wherein, in case that the first unit and the second unit are connected to each other, the distal end portion of the pressing portion is in contact with a side surface of the first unit at the first position.

4. A pressing apparatus according to claim 1, wherein the pressing portion is turned by the urging force of the urging portion in case that a holding mechanism configured to hold connection between the first unit and the second unit is released.

5. A pressing apparatus according to claim 1, wherein the pressing portion presses the first unit in the separating direction so as to push the second unit away from the first unit.

6. A pressing apparatus according to claim 1, wherein the pressing portion and the part are constructed of the same member.

7. A sheet conveying apparatus, which is connectable and separable with respect to a main body apparatus, the sheet conveying apparatus comprising:

a pressing portion configured to turn about a turn shaft and to press the main body apparatus, a turning of the pressing portion about the turn shaft exerting a force on the main body apparatus in a separating direction in which the sheet conveying apparatus and the main body apparatus being connected to each other are separated from each other, and an axial direction of the turn shaft intersecting with the separating direction;

a moving portion configured to turn the pressing portion about the turn shaft; and an urging portion configured to urge a part of the moving portion in the axial direction, an urging force of the urging portion performing a movement of the part of the moving portion in the axial direction, the movement causing the moving portion to turn the pressing portion about the turn shaft.

8. A sheet conveying apparatus according to claim 7, wherein the moving portion comprises:

a cam surface configured to be inclined with respect to the turn shaft; and a cam contact portion configured to be in contact with the cam surface, the cam contact portion being provided on the part of the moving portion, and wherein the cam surface is formed to turn the pressing portion along with the movement of the part of the moving portion.

9. A sheet conveying apparatus according to claim 7, wherein, in case that the sheet conveying apparatus is connected to the main body apparatus, the pressing portion is located at a first position at which the pressing portion is retracted to the sheet conveying apparatus, and wherein, in case that the sheet conveying apparatus is separated from the main body apparatus, the pressing portion is located at a second position at which the pressing portion is projected toward the main body apparatus.

10. A sheet conveying apparatus according to claim 9, further comprising a conveyance portion configured to convey a sheet toward the main body apparatus, wherein the pressing portion protects the conveyance portion in case that the pressing portion is located at the second position.

11. A sheet conveying apparatus according to claim 7, wherein the pressing portion is configured to move an openable and closable cover provided on the main body apparatus from an open position to a closed position along with a connecting operation of connecting the sheet conveying apparatus to the main body apparatus.

12. A sheet conveying apparatus according to claim 7, wherein the pressing portion presses the main body apparatus in the separating direction so as to push the sheet conveying apparatus away from the main body apparatus.

13. A sheet conveying apparatus according to claim 7, wherein the pressing portion and the part are constructed of the same member.

14. An image forming system comprising:

an image forming apparatus configured to form an image on a sheet;

a sheet conveying apparatus configured to connect to and separate from the image forming apparatus, and configured to convey a sheet to the image forming apparatus; and a pressing portion configured to turn about a turn shaft and to push the sheet conveying apparatus away from the image forming apparatus, a turning of the pressing portion about the turn shaft exerting a force on the main body apparatus in a separating direction in which the sheet conveying apparatus and the image forming apparatus being connected to each other are separated from each other, an axial direction of the turn shaft being intersecting with the separating direction, a moving portion configured to turn the pressing portion about the turn shaft; and an urging portion configured to urge a part of the moving portion in the axial direction, an urging force of the urging portion performing a movement of the part of the moving portion in the axial direction, the movement causing the moving portion to turn the pressing portion about the turn shaft, wherein the pressing portion is in contact with a side portion of the image forming apparatus in case that the sheet conveying apparatus is connected to the image forming apparatus.

15. An image forming system according to claim 14, wherein the moving portion comprises:

a cam surface configured to be inclined with respect to the turn shaft; and a cam contact portion configured to be in contact with the cam surface, the cam contact portion being provided on the part of the moving portion, and wherein the cam surface is formed to turn the pressing portion along with the movement of the part of the moving portion.

16. An image forming system according to claim 14, further comprising a holding mechanism configured to hold connection between the sheet conveying apparatus and the image forming apparatus, wherein the pressing apparatus pushes the sheet conveying apparatus away from the image forming apparatus in case that the connection held by the holding mechanism is released.

17. An image forming system according to claim 14, further comprising a guide rail configured to guide the sheet conveying apparatus in directions in which the sheet conveying apparatus is connected to and separated from the image forming apparatus.

18. An image forming system according to claim 14, further comprising:

an openable and closable cover provided on the image forming apparatus and being movable between an open position at which the openable and closable cover opens an inside of the image forming apparatus and a closed position at which the openable and closable cover closes the inside of the image forming apparatus; and a pair of guide members provided in the sheet conveying apparatus and forming a conveyance path configured to convey a sheet to the image forming apparatus, wherein the pressing portion is configured to come into contact with the openable and closable cover at the open position to move the openable and closable cover to the closed position along with a connecting operation of connecting the sheet conveying apparatus to the image forming apparatus.

19. An image forming system according to claim 18, wherein the pressing apparatus is configured so that the pressing portion located at a position at which the pressing portion is projected toward the image forming apparatus is brought into contact with the openable and closable cover located at the open position so as to move the openable and closable cover toward the closed position and, after the openable and closable cover is moved to the closed position, the pressing portion is turned to a position at which the pressing portion is retracted to the sheet conveying apparatus.

20. An image forming system according to claim 14, wherein the pressing portion and the part are constructed of the same member.

* * * * *